US010364820B1

(12) United States Patent
Oda et al.

(10) Patent No.: US 10,364,820 B1
(45) Date of Patent: Jul. 30, 2019

(54) COMPRESSOR AND COMPRESSOR-MANUFACTURING METHOD

(71) Applicant: MITSUBISHI HEAVY INDUSTRIES COMPRESSOR CORPORATION, Tokyo (JP)

(72) Inventors: Takashi Oda, Hiroshima (JP); Hitoshi Shinohara, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 16/116,572

(22) Filed: Aug. 29, 2018

Related U.S. Application Data

(63) Continuation of application No. PCT/JP2018/017176, filed on Apr. 27, 2018.

(51) Int. Cl.
*F04D 17/12* (2006.01)
*F04D 29/08* (2006.01)
*F04D 29/62* (2006.01)

(52) U.S. Cl.
CPC ..... *F04D 29/083* (2013.01); *F04D 17/125* (2013.01); *F04D 29/622* (2013.01); *F04D 29/624* (2013.01)

(58) Field of Classification Search
CPC .... F04D 17/125; F04D 29/083; F04D 29/622; F04D 29/624
See application file for complete search history.

(56) References Cited

U.S. PATENT DOCUMENTS 3,229,642 A * 1/1966 Lobanoff ..... F04D 1/063 415/100
3,976,395 A * 8/1976 Kalnin ..... F04D 1/063 415/199.2
7,513,735 B2 4/2009 Sarri
(Continued)

FOREIGN PATENT DOCUMENTS

JP S56-041482 A 4/1981
JP H10-220399 A 8/1998
(Continued)

OTHER PUBLICATIONS

Written Opinion issued in corresponding International Application No. PCT/JP2018/017176 dated Jul. 24, 2018 (9 pages).
(Continued)

*Primary Examiner* — Richard A Edgar
*Assistant Examiner* — Brian O Peters
(74) *Attorney, Agent, or Firm* — Osha Liang LLP

(57) ABSTRACT

A compressor includes a casing having an upper half casing and a lower half casing and a tubular shape with both ends open, a bundle including annular heads respectively fixed on both sides in an axial direction with respect to a plurality of diaphragms and closing openings of the casing, a communication clearance seal portion sealing a communication clearance extending in the axial direction between the outer peripheral surface of the diaphragm and the inner peripheral surface of the casing such that a suction opening and a discharge opening communicate with each other, and a regulating portion regulating the position of the head in the axial direction with respect to the casing.

17 Claims, 24 Drawing Sheets

(56) References Cited

U.S. PATENT DOCUMENTS

| | | | | |
|---|---|---|---|---|
| 9,631,637 | B2 * | 4/2017 | Sassanelli | F04D 29/124 |
| 2010/0270308 | A1 | 10/2010 | Naruse et al. | |
| 2013/0272853 | A1 * | 10/2013 | Shinohara | F04D 17/12<br>415/170.1 |
| 2014/0178183 | A1 * | 6/2014 | Masuda | F04D 29/4206<br>415/173.1 |

FOREIGN PATENT DOCUMENTS

| | | | |
|---|---|---|---|
| JP | 2003-269390 | A | 9/2003 |
| JP | 2010-255459 | A | 11/2010 |
| JP | 2013-072356 | A | 4/2013 |
| WO | 2005/045251 | A1 | 5/2005 |

OTHER PUBLICATIONS

International Search Report issued in corresponding International Application No. PCT/JP2018/017176 dated Jul. 24, 2018 (4 pages).

* cited by examiner

COMPRESSOR AND COMPRESSOR-MANUFACTURING METHOD

CROSS-REFERENCE TO RELATED APPLICATION

This application is a continuation application based on a PCT Patent Application No. PCT/JP2018/017176, filed Apr. 27, 2018 the entire contents of which is hereby incorporated by reference.

BACKGROUND OF THE INVENTION

Field of the Invention

The present invention relates to a compressor and a compressor-manufacturing method.

Description of Related Art

A centrifugal compressor allows gases to pass through a rotating impeller and compresses the gases using the centrifugal force generated at that time. A multistage centrifugal compressor is well-known as a centrifugal compressor, and is provided with a plurality of impellers that compress gases in stages.

The centrifugal compressor as described above has a structure that is provided with a casing which is vertically divisible with a horizontally spreading divided surface. Specifically, the casing is configured by fastening a lower half casing installed on a floor surface and an upper half casing disposed on the lower half casing with bolt or the like. In the centrifugal compressor, a rotor is disposed to penetrate the casing. The rotor is rotatable with respect to the casing.

PTL 1, for example, discloses a multistage centrifugal compressor provided with a diaphragm formed in an annular shape by an upper half diaphragm and a lower half diaphragm that have a semicircular ring shape being combined with each other. In this multistage centrifugal compressor, a plurality of the combined diaphragms are fixed and adjacent to each other in an axial direction in a vertically divisible casing. In addition, the outer peripheral surface of the diaphragm is provided with a vertically divisible ring member. The position of the diaphragm in the axial direction with respect to the casing is regulated by this ring member.

PTL 2 also discloses a compressor that has a vertically divisible casing. In the compressor disclosed in PTL 2, an internal unit in which a diaphragm and a rotor are integrally formed is disposed in the vertically divisible casing. The internal unit is provided with a pair of heads disposed on both sides of the rotor in an axial direction to sandwich a plurality of the diaphragms and seal the openings at both ends of the casing. In addition, a plurality of fitting recessed portions are formed in the casing. The position of the diaphragm in the axial direction with respect to the casing is regulated by a plurality of fitting projecting portions formed in the diaphragm and the head fitting in this fitting recessed portion.

In this manner, in the compressor as described above, a structure regulating the position of the diaphragm in the axial direction with respect to the casing is disposed between the inner peripheral surface of the casing and the outer peripheral surfaces of the plurality of diaphragms.

CITATION LIST

Patent Documents

[PTL 1] U.S. Pat. No. 7,513,735

[PTL 2] Japanese Unexamined Patent Application, First Publication No. 2013-72356

SUMMARY OF THE INVENTION

In a case where the casing has a vertically divided structure and the diaphragm therein is integrally formed, a clearance is formed between the inner peripheral surface of the casing and the outer peripheral surface of the diaphragm. When the diaphragm position-regulating structure is disposed simply in this clearance as in PTL 1 and PTL 2, a suction port and a discharge port are connected via the clearance. As a result, the difference between the pressures of the discharge and suction ports causes a fluid to flow into the clearance from the discharge port toward the suction port, and then fluid leakage may occur. Leakage reduction between the inner peripheral surface of the casing and the outer peripheral surface of the diaphragm is desirable.

The present invention provides a compressor and a compressor-manufacturing method allowing leakage to be reduced between the inner peripheral surface of a casing and the outer peripheral surface of a diaphragm.

A compressor according to a first aspect of the present invention includes a casing including an upper half casing having an upper half casing-divided surface as a horizontal surface facing downward in a vertical direction and a lower half casing having a lower half casing-divided surface capable of abutting against the upper half casing-divided surface, the casing having a tubular shape with both ends open, a bundle including an impeller rotatable about an axis, a plurality of diaphragms in which the impeller is accommodated and a flow path introducing a fluid to a flow path of the impeller is formed, and annular heads respectively fixed on both sides in an axial direction in which the axis extends with respect to the plurality of diaphragms and closing openings of the casing, the bundle being accommodated in the casing, a communication clearance seal portion sealing a communication clearance extending in the axial direction between an outer peripheral surface of the diaphragm and an inner peripheral surface of the casing such that a suction port through which the fluid flows in and a discharge port through which the fluid is discharged communicate with each other, and a regulating portion provided in at least one of the casing and the head and regulating a position of the head in the axial direction with respect to the casing.

According to this configuration, by the communication clearance being formed between the outer peripheral surface of the diaphragm and the inner peripheral surface of the casing, interference or the like during assembly of the bundle and the casing that has the vertically divided structure can be prevented and assemblability can be improved. Furthermore, by the communication clearance being sealed, a high-pressure fluid supplied to the discharge port can be prevented from leaking out from the suction port through the communication clearance.

In the compressor according to a second aspect of the present invention, according to the first aspect, the regulating portion may include a fitting recessed portion formed in one of an outer peripheral surface of the head and the inner peripheral surface of the casing and a fitting projecting portion formed in the other one of the outer peripheral surface of the head and the inner peripheral surface of the casing and fitting into the fitting recessed portion.

According to this configuration, the position of the head in the axial direction with respect to the casing can be regulated with a simple structure. In addition, the regulating portion is directly formed as a part of the head and the casing instead of as a separate member. Accordingly, the number of parts to be assembled decreases and adjustment during assembly of the casing and the bundle is facilitated.

In the compressor according to a third aspect of the present invention, according to the first aspect, the regulating portion may be disposed on an outside in the axial direction as a side opposite to a side where the diaphragm is disposed with respect to the head in the casing and in contact with a surface of the head facing the outside in the axial direction.

According to this configuration, the position of the head in the axial direction with respect to the casing can be regulated at a part positioned outside the compressor. Accordingly, a regulated state of the position of the bundle with respect to the casing can be confirmed at a position visible from the outside.

In the compressor according to a fourth aspect of the present invention, according to the third aspect, the casing may include a casing main body covering an outer peripheral surface of the bundle and a protruding portion protruding from the casing main body toward an inside in a radial direction and in contact with an end surface of the head facing the outside in the axial direction as the regulating portion.

According to this configuration, the protruding portion is unlikely to be limited in terms of space since the protruding portion is positioned outside the compressor. Accordingly, when the thrust force generated in the bundle is large in accordance with the type of a fluid to be compressed, the protruding portion can be enlarged in accordance with the force that is generated in the bundle. As a result, the position of the bundle with respect to the casing can be stably held.

In the compressor according to a fifth aspect of the present invention, according to the third or fourth aspect, the regulating portion may include a regulating accommodating recessed portion recessed from the inner peripheral surface of the casing to be positioned on the outside in the axial direction at least in part with respect to the head, a first regulating member accommodated in the regulating accommodating recessed portion and in contact with the surface of the head facing the outside in the axial direction, and a second regulating member accommodated in the regulating accommodating recessed portion outside the first regulating member in the axial direction and in contact with a surface of the regulating accommodating recessed portion facing an inside in the axial direction as a side where the diaphragm is disposed and a surface of the first regulating member facing the outside in the axial direction.

According to this configuration, the first regulating member and the second regulating member can be attached from the outside after the bundle and the casing are assembled. Accordingly, the positions of the bundle, the lower half casing, and the upper half casing in the axial direction do not have to be finely adjusted in a case where the bundle is installed in the lower half casing and in a case where the upper half casing is installed on the bundle. As a result, assemblability can be improved even more.

In the compressor according to a sixth aspect of the present invention, according to any one of the first to fifth aspects, the communication clearance seal portion may be an O ring, a clearance seal attachment groove to which the communication clearance seal portion is attached may be formed in the outer peripheral surface of the diaphragm, and the clearance seal attachment groove may be formed to become deep toward a circumferential direction from at least one of an upper vertex of the diaphragm in the vertical direction and a lower vertex of the diaphragm in the vertical direction.

Both ends of the diaphragm in the horizontal direction are close to the divided surface of the casing. Accordingly, once the protruding amount of the communication clearance seal portion increases at both ends in the horizontal direction, damage may arise, by the communication clearance seal portion being sandwiched by the divided surface or being rubbed against an edge of the casing, when the upper half casing is attached to the lower half casing. The clearance seal attachment groove, however, is formed to become deep toward the circumferential direction. Accordingly, the communication clearance seal portion fitting into the clearance seal attachment groove has a protruding amount from the outer peripheral surface of the diaphragm that decreases from the upper vertex in the vertical direction or the lower vertex in the vertical direction toward the circumferential direction. As a result, damage to the communication clearance seal portion at a time when the upper half casing is attached to the lower half casing can be reduced.

In the compressor according to a seventh aspect of the present invention, according to the sixth aspect, the clearance seal attachment groove may be formed to be deepest at both end positions in a horizontal direction having an angular difference of 90 degrees in the circumferential direction of the diaphragm with respect to the upper vertex of the diaphragm in the vertical direction and the lower vertex of the diaphragm in the vertical direction.

According to this configuration, the protruding amount of the communication clearance seal portion is the least at both ends in the horizontal direction. Accordingly, damage to the communication clearance seal portion at a time when the upper half casing is attached to the lower half casing can be more effectively reduced.

The compressor according to an eighth aspect of the present invention, according to any one of the first to seventh aspects may further include a fastening portion fixing the diaphragm and a discharge side head as the head disposed at a position close to the discharge port, in which the fastening portion may include a fixed hole formed in a surface of one of the discharge side head and the diaphragm facing the axial direction and having a female screw in the fixed hole, a fastening through-hole formed at a position overlapping the fixed hole when seen from the axial direction in the other one of the discharge side head and the diaphragm, a bolt member having a shaft portion having an outer peripheral surface provided with a male screw and fixed to the fixed hole in a state where the shaft portion is inserted in the fastening through-hole and a head portion formed in an end portion of the shaft portion, and an elastic member disposed between the head portion of the bolt member and a surface where the fastening through-hole is formed.

According to this configuration, during an operation of the compressor, a fluid increased in temperature and pressure as a result of compression may circulate in the vicinity of the discharge port, and this circulation may result in heating of the diaphragm and the discharge side head and heat extension in the axial direction. In this case, a force causing pulling in the axial direction acts on the bolt member. In a case where deformation in the axial direction occurs in the diaphragm and the discharge side head, however, the force acting on the bolt member is absorbed by compression of the elastic member pinched between the head portion and the surface where the fastening through-hole is formed. As a result, damage such as breakage of the bolt member can be forestalled.

The compressor according to a ninth aspect of the present invention, according to any one of the first to eighth aspects may further include a head seal portion providing sealing between the head and the casing, in which the head seal portion may include an annular ring insertion portion movable in the axial direction from an outside of the head or the casing and inserted between the outer peripheral surface of the head and the inner peripheral surface of the casing, an inside ring seal portion providing sealing between an inner peripheral surface of the ring insertion portion and the outer peripheral surface of the head, and an outside ring seal portion providing sealing between an outer peripheral surface of the ring insertion portion and the inner peripheral surface of the casing.

According to this configuration, sealing can be performed between the head and the casing by the ring insertion portion being moved from the outside after the bundle and the casing are assembled. Accordingly, before the bundle and the casing are assembled, the inside seal ring and the outside seal ring can be assembled away from the casing. Accordingly, damage caused by the inside seal ring and the outside seal ring being sandwiched by the divided surface or being rubbed against an edge of the casing can be reduced. As a result, the sealability between the head and the casing can be stably ensured.

In the compressor according to a tenth aspect of the present invention, according to the ninth aspect, the ring insertion portion may be detachable with respect to the head or the casing from the outside in the axial direction as the side opposite to the side where the diaphragm is disposed.

According to this configuration, sealing can be performed between the head and the casing by the ring insertion portion being inserted after the upper casing is installed on the bundle. Accordingly, damage to the inside seal ring and the outside seal ring during the assembly of the bundle and the casing can be prevented. As a result, the sealability between the head and the casing can be more stably ensured.

In the compressor according to an eleventh aspect of the present invention, according to the ninth or tenth aspect, an insertion clearance diameter-enlarged portion enlarging a clearance between the outer peripheral surface of the ring insertion portion and the inner peripheral surface of the casing may be formed at a position shifted in the axial direction with respect to the outside ring seal portion.

According to this configuration, the clearance between the outer peripheral surface of the ring insertion groove and the inner peripheral surface of the casing increases. As a result, damage attributable to rubbing of the inside ring seal portion and the outside ring seal portion against the inner peripheral surface of the casing during insertion of the ring insertion portion into the ring insertion groove can be reduced.

The compressor according to a twelfth aspect of the present invention, according to any one of the first to eleventh aspects may further include a movement-holding portion capable of allowing the discharge side head as the head disposed at the position close to the discharge port to move relative to the casing in the axial direction and capable of holding the position of the discharge side head at any position in the axial direction, in which the movement-holding portion may hold the position of the discharge side head at a position where the discharge side head is farthest from the diaphragm and where the discharge side head is immovable toward the outside in the axial direction as the side opposite to the side where the diaphragm is disposed.

According to this configuration, the discharge side head can be moved via the movement-holding portion after the bundle and the casing are assembled. Accordingly, the position of the discharge side head in the axial direction with respect to the casing can be determined from the outside of the compressor. As a result, the positions of the bundle and the casing in the axial direction do not have to be finely adjusted when the casing and the bundle are assembled. As a result, assemblability can be improved even more.

In the compressor according to a thirteenth aspect of the present invention, according to the twelfth aspect, the movement-holding portion may include a fixed member having a fixed member communication hole communicating in the axial direction and fixed to the discharge side head, a shaft member having an outer peripheral surface provided with a male screw and one end fixed to the casing in a state where the shaft member is inserted in the fixed member communication hole, a first nut in which a female screw is formed, the first nut being movable relative to the shaft member in a state where the shaft member is inserted in the first nut and disposed on the casing side in the axial direction with respect to the fixed member, and a second nut in which a female screw is formed, the second nut being movable relative to the shaft member in a state where the shaft member is inserted in the second nut and disposed on a side opposite to the first nut with respect to the fixed member.

According to this configuration, the discharge side head can be moved simply by the first nut and the second nut being rotated with respect to the shaft member for a movement toward the axial direction. Accordingly, the discharge side head can be moved with a simple structure and without a complex device.

In the compressor according to a fourteenth aspect of the present invention, according to any one of the first to thirteenth aspects, a wire insertion portion allowing a wire to be inserted may be formed at a lower end of the head in the vertical direction.

According to this configuration, the bundle can be moved in a stable state even in the event of an increase in the weight of the bundle.

A compressor-manufacturing method according to a fifteenth aspect of the present invention includes a casing preparation step of preparing a casing including an upper half casing having an upper half casing-divided surface as a horizontal surface facing downward in a vertical direction and a lower half casing having a lower half casing-divided surface capable of abutting against the upper half casing-divided surface, the casing having a tubular shape with both ends open, a bundle preparation step of preparing a bundle including an impeller rotatable about an axis, a plurality of diaphragms in which the impeller is accommodated and a flow path introducing a fluid to a flow path of the impeller is formed, annular heads respectively fixed on both sides in an axial direction in which the axis extends with respect to the plurality of diaphragms and closing openings of the casing, and a communication clearance seal portion disposed in an outer peripheral surface of the diaphragm, a bundle disposition step of accommodating the bundle on an inner peripheral side of the lower half casing by lowering the bundle from above in the vertical direction with respect to the lower half casing such that a clearance extending in the axial direction such that a suction port through which a fluid flows in and a discharge port through which a fluid is discharged communicate with each other is formed between the outer peripheral surface of the diaphragm and an inner peripheral surface of the lower half casing, and an upper half casing disposition step of disposing the upper half casing on the lower half casing in which the bundle is accommodated, by lowering the upper half casing from above in the vertical direction with respect to the bundle such that the clearance extending in the axial direction such that the suction port and the discharge port communicate with each other is formed between the outer peripheral surface of the diaphragm and an inner peripheral surface of the upper half casing and abutting the upper half casing-divided surface against the lower half casing-divided surface, in which the bundle is disposed such that the communication clearance seal portion comes into contact with the inner peripheral surface of the lower half casing in a state where a position of the head in the axial direction is regulated with respect to the lower half casing in the bundle disposition step and the upper half casing is disposed such that the communication clearance seal portion comes into contact with the inner peripheral surface of the upper half casing in a state where the position of the head in the axial direction is regulated with respect to the upper half casing in the upper half casing disposition step.

The compressor-manufacturing method according to a sixteenth aspect of the present invention, according to the fifteenth aspect may further include a head seal portion preparation step of preparing a head seal portion including an annular ring insertion portion insertable between an outer peripheral surface of the head and an inner peripheral surface of the casing, an inside ring seal portion capable of providing sealing between an inner peripheral surface of the ring insertion portion and the outer peripheral surface of the head, and an outside ring seal portion capable of providing sealing between an outer peripheral surface of the ring insertion portion and the inner peripheral surface of the casing, the head seal portion providing sealing between the head and the casing and a head seal portion movement step of bringing the inside ring seal portion into contact with the inner peripheral surface of the ring insertion portion and the outer peripheral surface of the head and brining the outside ring seal portion into contact with the outer peripheral surface of the ring insertion portion and the inner peripheral surface of the casing by moving the ring insertion portion in the axial direction from an outside of the head or the casing, the head seal portion movement step being carried out after the upper half casing disposition step.

In the compressor-manufacturing method according to a seventeenth aspect of the present invention, according to the sixteenth aspect, the ring insertion portion may be inserted between the outer peripheral surface of the head and the inner peripheral surface of the casing from an outside in the axial direction as a side opposite to a side where the diaphragm is disposed with respect to the head or the casing in the head seal portion movement step.

The compressor-manufacturing method according to an eighteenth aspect of the present invention, according to any one of the fifteenth to seventeenth aspects may further include a movement-holding portion preparation step of preparing a movement-holding portion capable of allowing a discharge side head as the head disposed at a position close to the discharge port to move relative to the casing in the axial direction and capable of holding the position of the discharge side head at any position in the axial direction, a fixing release step of releasing fixing of the discharge side head and the diaphragm, the fixing release step being carried out after the bundle disposition step and before the upper half casing disposition step, and a discharge side head movement step of holding the position of the discharge side head after a movement by the movement-holding portion to a position where the discharge side head is farthest from the diaphragm and the discharge side head is immovable toward the outside in the axial direction as the side opposite to the side where the diaphragm is disposed, the discharge side head movement step being carried out after the upper half casing disposition step.

In the compressor-manufacturing method according to a nineteenth aspect of the present invention, according to the eighteenth aspect, the discharge side head and the diaphragm may be fixed only at a position communicating with the outside in a state where the bundle is disposed with respect to the lower half casing in the bundle preparation step.

With the present invention, leakage can be reduced between the inner peripheral surface of a casing and the outer peripheral surface of a diaphragm.

DETAILED DESCRIPTION OF THE INVENTION

First Embodiment

Hereinafter, embodiments of a compressor according to the present invention will be described with reference to accompanying drawings.

Figure 1:
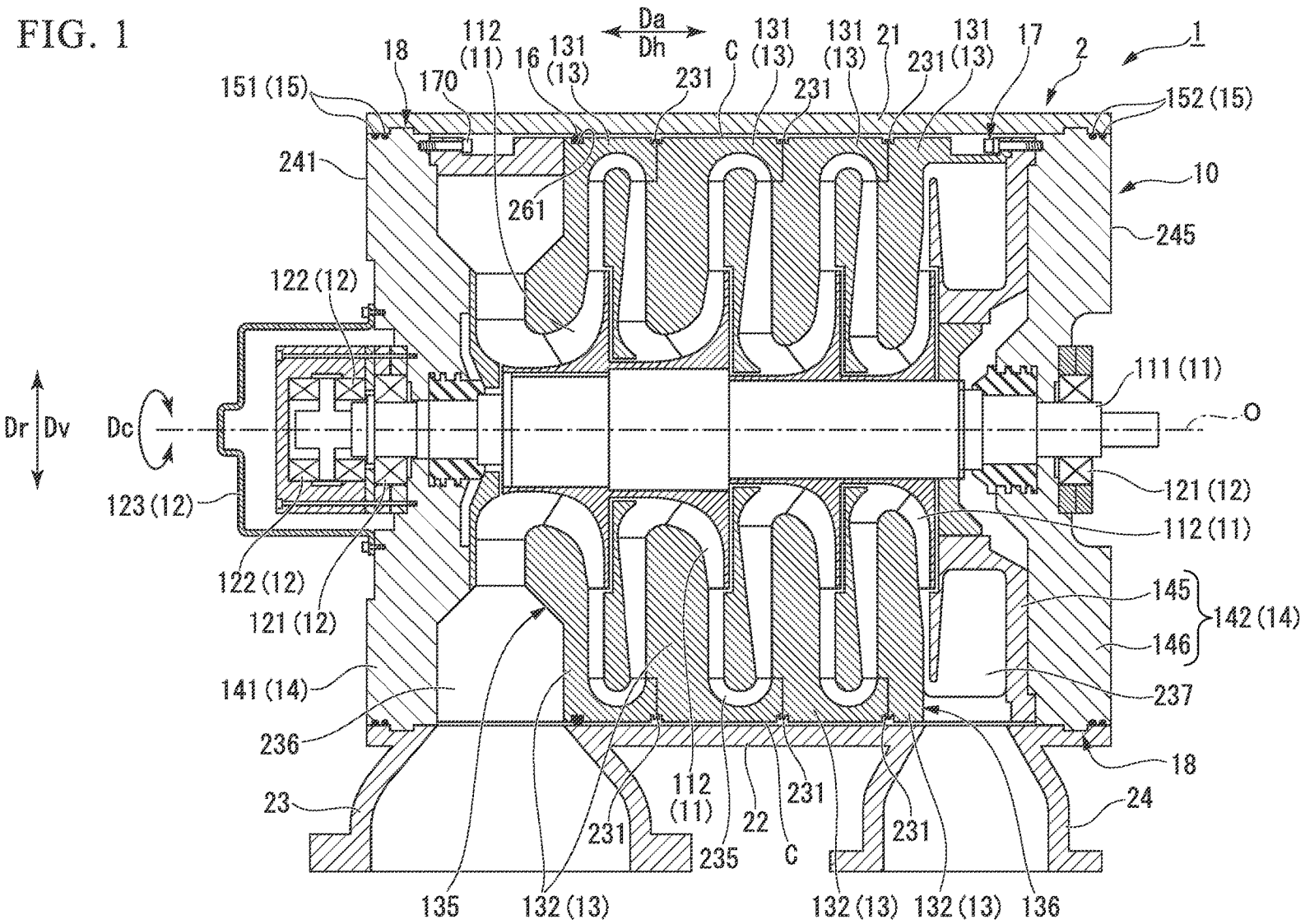
FIG. 1 is a sectional view schematically illustrating the configuration of a compressor according to a first embodiment of the present invention.
Figure 2:
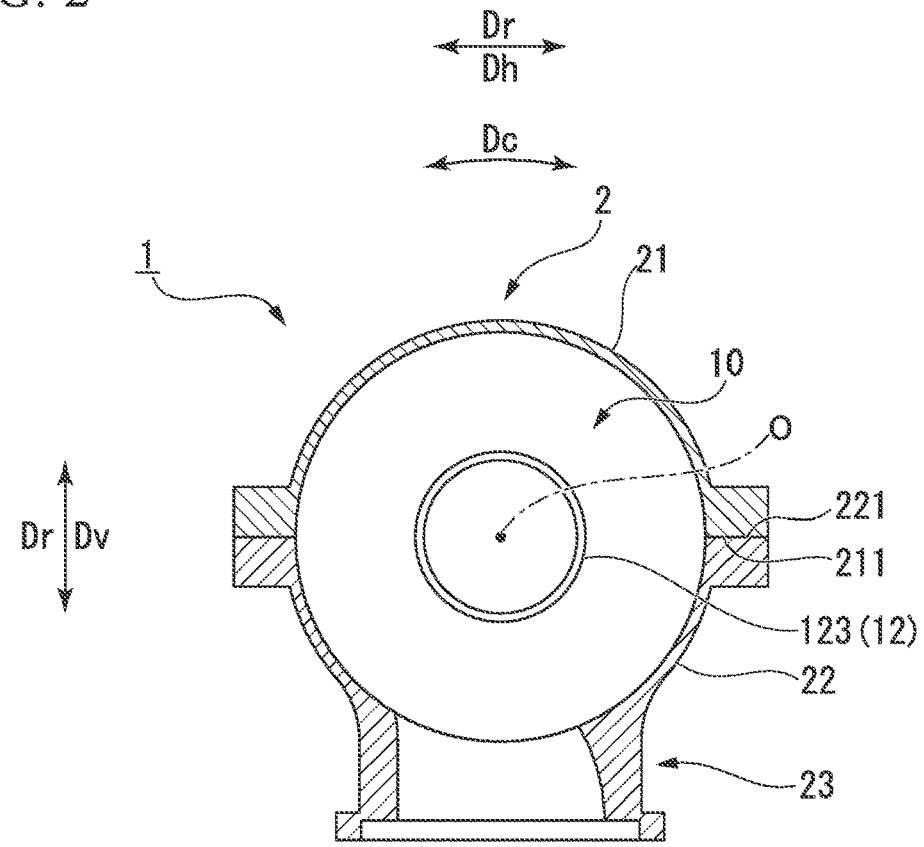
FIG. 2 is a schematic diagram schematically illustrating the compressor according to the first embodiment of the present invention that is seen from one side in an axial direction.

As illustrated in FIG. 1, a compressor 1 according to the present embodiment is a uniaxial multistage centrifugal compressor (multistage centrifugal compressor) provided with a plurality of impellers 112. As illustrated in FIGS. 1 and 2, the compressor 1 according to the present embodiment is provided with a casing 2, a bundle 10, and a regulating portion 18.

In the following description, the direction in which an axis O of a rotor 11 (described later) extends will be referred to as an axial direction Da. A radial direction based on the axis O will be simply referred to as a radial direction Dr. The up-down direction of the page of FIGS. 1 and 2 among the radial directions Dr perpendicular to the axis O will be referred to as a vertical direction Dv. In addition, the left-right direction of FIGS. 1 and 2 that is the axial direction Da and the radial direction Dr perpendicular to the axis O will be referred to as a horizontal direction Dh. In addition, a direction around the rotor 11 about the axis O will be referred to as a circumferential direction Dc.

The casing 2 is disposed to cover the bundle 10 from an outer peripheral side. The casing 2 has a tubular shape, with both ends open, about a central axis that has the same disposition as the axis O of the rotor 11 (described later). The tubular casing 2 has an upper half casing 21 on the upper side in the vertical direction Dv and a lower half casing 22 on the lower side in the vertical direction Dv (refer to FIG. 2).

The upper half casing 21 extends in the axial direction Da with a section orthogonal to the axis O having a semicircular ring shape about the axis O. The upper half casing 21 is open downward in the vertical direction Dv such that the bundle 10 fits in the upper half casing 21. As a result, the upper half casing 21 covers, from above, the outer peripheral surface of the bundle 10 accommodated in the upper half casing 21. As illustrated in FIG. 2, flanges extending in the horizontal direction Dh are formed at both ends of the upper half casing 21 in the circumferential direction Dc according to the present embodiment. The upper half casing 21 has an upper half casing-divided surface 211 at both ends in the circumferential direction Dc. The upper half casing-divided surface 211 is one divided surface at a time when the casing 2 is divided into the upper and lower parts in the vertical direction Dv. The upper half casing-divided surface 211 is a flat surface spreading in the radial direction Dr and the axial direction Da. In other words, the upper half casing-divided surface 211 is a horizontal surface facing downward in the vertical direction Dv.

The lower half casing 22 extends in the axial direction Da with a section orthogonal to the axis O having a semicircular ring shape about the axis O. The lower half casing 22 is open upward in the vertical direction Dv such that the bundle 10 fits in the lower half casing 22. As a result, the lower half casing 22 covers, from below, the outer peripheral surface of the bundle 10 accommodated in the lower half casing 22. Flanges extending in the horizontal direction Dh are formed at both ends of the lower half casing 22 in the circumferential direction Dc according to the present embodiment. The lower half casing 22 has a lower half casing-divided surface 221 at both ends in the circumferential direction Dc. The lower half casing-divided surface 221 is the other divided surface at a time when the casing 2 is divided into the upper and lower parts in the vertical direction Dv. The lower half casing-divided surface 221 is a flat surface spreading in the radial direction Dr and the axial direction Da. In other words, the lower half casing-divided surface 221 is a horizontal surface facing upward in the vertical direction Dv. In addition, as illustrated in FIG. 1, the lower half casing 22 has a suction port 23 supplying a process gas (fluid) to be compressed into the casing 2 and a discharge port 24 discharging a compressed processed gas from the inner portion of the casing 2.

The bundle 10 is accommodated in the casing 2. The bundle 10 according to the present embodiment has the rotor 11, a bearing portion 12, a plurality of diaphragms 13, a plurality of heads 14, a head seal portion 15, a communication clearance seal portion 16, and a fastening portion 17. In the bundle 10, the rotor 11, the bearing portion 12, the plurality of diaphragms 13, the plurality of heads 14, the head seal portion 15, the communication clearance seal portion 16, and the fastening portion 17 are movable in one piece.

The rotor 11 is rotatable about the axis O. The rotor 11 has a rotor shaft 111 extending in the axial direction Da about the axis O and the plurality of impellers 112 rotating with the rotor shaft 111.

The impeller 112 is fixed to the outer peripheral surface of the rotor shaft 111. The impeller 112 compresses a process gas using a centrifugal force by rotating with the rotor shaft 111. The impeller 112 is disposed in a plurality of stages in the axial direction Da with respect to the rotor shaft 111. The impeller 112 is a so-called open type impeller provided with a disk and a blade.

The bearing portion 12 supports the rotor shaft 111 about the axis O in a rotatable manner. The bearing portion 12 is fixed to the head 14 (described later). The bearing portion 12 has a pair of journal bearings 121 respectively disposed at both ends of the rotor shaft 111 and a thrust bearing 122 disposed at one end of the rotor shaft 111.

The pair of journal bearings 121 receive a load in the radial direction Dr that acts on the rotor shaft 111. The journal bearings 121 are respectively fixed to a pair of the heads 14 by means of detachable fixing means (not illustrated) such as a bolt.

The thrust bearing 122 receives a load in the axial direction Da that acts on the rotor shaft 111. The thrust bearing 122 is attached in the inner portion of a box-shaped bearing cover 123. The bearing cover 123 is fixed to one of the heads 14 by means of detachable fixing means such as a bolt.

The diaphragm 13 is disposed to cover the rotor 11 from an outer peripheral side. The diaphragm 13 is annular about the axis O. The annular diaphragm 13 has an upper half diaphragm 131 that has a semicircular ring shape on the upper side in the vertical direction Dv based on the axis O of the rotor 11 and a lower half diaphragm 132 that has a semicircular ring shape on the lower side in the vertical direction Dv based on the axis O of the rotor 11. The upper half diaphragm 131 and the lower half diaphragm 132 are fixed by detachable fixing means such as a bolt. The plurality of (four in the present embodiment) diaphragms 13 are aligned to be stacked in the axial direction Da. The plurality of diaphragms 13 have a tubular shape extending in the axial direction Da. By the plurality of diaphragms 13 being mutually fixed, a flow path for introducing the process gas into introduced to the flow path of the impeller 112 is defined inside.

Figure 3:
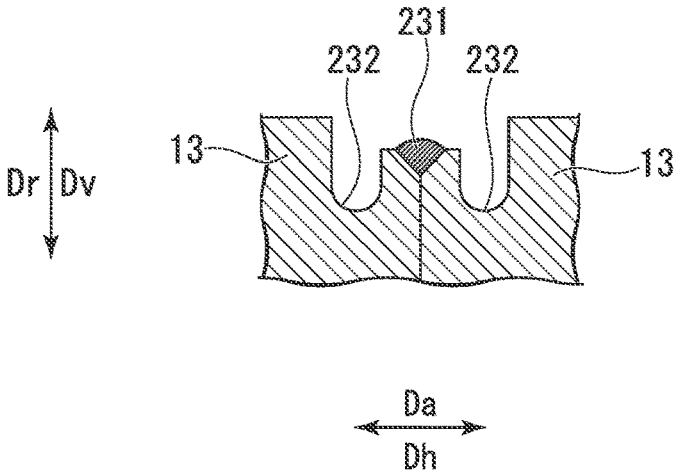
FIG. 3 is an enlarged view of a main part illustrating a welding portion of adjacent diaphragms according to the embodiment of the present invention.

Specifically, the outer peripheral surfaces of the diaphragms 13 that are adjacent to each other are fixed to each other by welding. As illustrated in FIG. 3, in the adjacent diaphragms 13, a welding portion 231 is formed at the corner portions that face the outer peripheral surfaces. The plurality of diaphragms 13 are integrated by being mutually fixed by the welding portion 231.

In addition, welding portion grooves 232 are formed in the adjacent diaphragms 13 such that the welding portion 231 is pinched from the axial direction Da. The welding portion groove 232 is recessed toward the inside of the radial direction Dr from the outer peripheral surfaces of the upper half diaphragm 131 and the lower half diaphragm 132. The welding portion groove 232 is formed over the entire circumference of the circumferential direction Dc with respect to the outer peripheral surface of the diaphragm 13.

Here, the flow path that is formed by the diaphragm 13 will be described in detail in sequence from an upstream side as one side (first side) in the axial direction Da. As illustrated in FIG. 1, in the present embodiment, the diaphragm 13 defines, with the casing 2 and the head 14, a suction opening 236, a plurality of casing flow paths 235, and a discharge opening 237 in sequence from the upstream side where a process gas circulates.

The suction opening 236 allows the process gas flowing in from the outside of the casing 2 via the suction port 23 to flow into the casing flow path 235 in the diaphragm 13. The suction opening 236 allows the process gas to flow into the most upstream impeller 112. The suction opening 236 is provided with an inlet guide vane.

The casing flow path 235 is formed in the diaphragm 13. The casing flow path 235 supplies the process gas from the suction opening 236 to the most upstream impeller 112, supplies the process gas discharged from the upstream impeller 112 to the impeller 112 disposed downstream, or allows the process gas discharged from the most downstream impeller 112 to be supplied to the discharge opening 237.

The discharge opening 237 allows the process gas flowing through the diaphragm 13 to be discharged to the outside of the casing 2 via the discharge port 24. The discharge opening 237 allows the process gas discharged from the most downstream impeller 112 to be discharged to the outside.

The pair of heads 14 are annular members formed with a size with which the openings at both ends of the casing 2 can be closed. Both end portions of the rotor shaft 111 are respectively inserted with respect to the heads 14. The head 14 according to the present embodiment has a suction side head 141 disposed on the one side (first side) in the axial direction Da with respect to the plurality of diaphragms 13 and a discharge side head 142 disposed on the other side (second side) in the axial direction Da with respect to the plurality of diaphragms 13.

The suction side head 141 is disposed at a position closer to the suction opening 236 than the discharge side head 142. The suction side head 141 forms the suction opening 236 with an entrance wall 135, which is the diaphragm 13 that is disposed on the most one side (outermost) in the axial direction Da. A suction side head exterior surface 241, which is the surface of the suction side head 141 that faces the one side in the axial direction Da, faces the outside of the compressor 1. The suction side head 141 is fixed to the plurality of integrated diaphragms 13 by means of a bolt member 170. Specifically, the bolt member 170 is disposed via a groove recessed from the outer peripheral surface of the entrance wall 135. The entrance wall 135 and the suction side head 141 are fixed with the bolt member 170 in two places in the upper half diaphragm 131 and in two places in the lower half diaphragm 132. The places of the fixing by the bolt member 170 are not limited to the two respective places and may also be three or more places. As a result, the suction side head 141 is integrated with the diaphragm 13.

The discharge side head 142 is disposed at a position closer to the discharge opening 237 than the suction side head 141. The discharge side head 142 forms the discharge opening 237 with a final stage diaphragm 136, which is the diaphragm 13 that is disposed on the most other side (outermost) in the axial direction Da. The discharge side head 142 according to the present embodiment has an exit wall portion 145 forming a part of the discharge opening 237 and a discharge side head main body 146 fixed to the exit wall portion 145.

The discharge side head main body 146 is adjacent to the other side of the exit wall portion 145 in the axial direction Da. A discharge side head exterior surface 245, which is the surface of the discharge side head main body 146 that faces the other side in the axial direction Da, faces the outside of the compressor 1. The distance from the suction side head exterior surface 241 to the discharge side head exterior surface 245 in the axial direction Da is substantially equal to the length of the casing 2 in the axial direction Da. In other words, in the present embodiment, both ends of the casing 2 do not protrude from the suction side head exterior surface 241 and the discharge side head exterior surface 245.

The head seal portion 15 provides sealing between the outer peripheral surface of the head 14 and the inner peripheral surface of the casing 2. The head seal portion 15 according to the first embodiment has a first head seal portion 151 disposed in the suction side head 141 and a second head seal portion 152 disposed in the discharge side head 142. Here, the first head seal portion 151 and the second head seal portion 152 have the same structure, and thus the first head seal portion 151 will be described below as an example.

Figure 4:
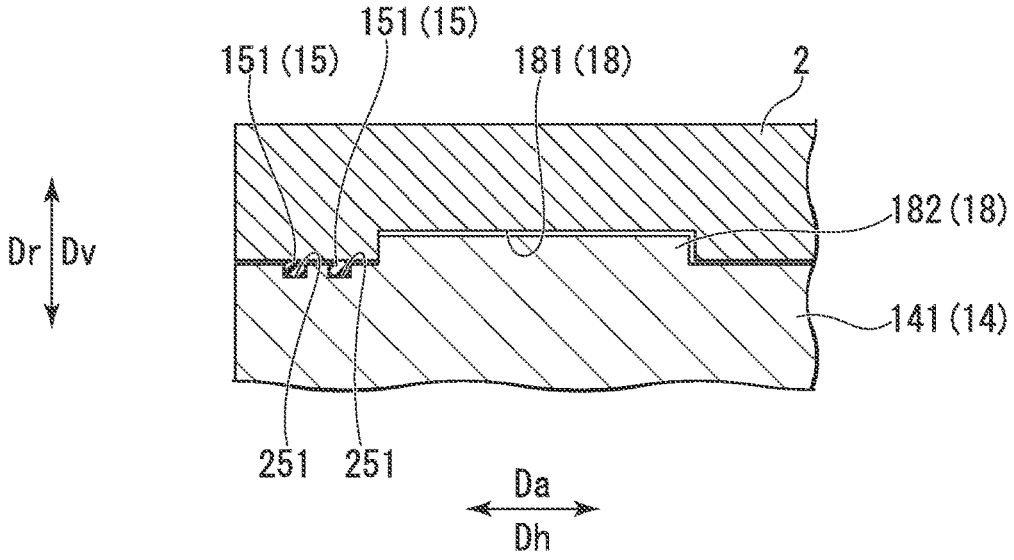
FIG. 4 is an enlarged view of a main part illustrating a regulating portion and a head seal portion according to the first embodiment of the present invention.

The first head seal portion 151 has an annular shape and surrounds the suction side head 141 over the entire circumference. As illustrated in FIG. 4, the first head seal portion 151 is an O ring accommodated in a head seal attachment groove 251 formed in the outer peripheral surface of the suction side head 141. Two first head seal portions 151 are disposed to be aligned in the axial direction Da with respect to the suction side head 141.

Two head seal attachment grooves 251 are formed to be aligned in the axial direction Da. In the outer peripheral surface of the head 14, the head seal attachment groove 251 is formed at a position as close as possible to the outside in the axial direction Da (side opposite to the side where the diaphragm 13 is disposed with respect to the head 14).

Here, the outside in the axial direction Da is the direction toward the outside of the compressor 1. Accordingly, the outside in the axial direction Da for the suction side head 141 is the one side in the axial direction Da and the outside in the axial direction Da for the discharge side head 142 is the other side in the axial direction Da. Likewise, the inside in the axial direction Da is the direction opposite to the outside in the axial direction Da and the direction facing the central position of the bundle 10 of the compressor 1 in the axial direction Da. Accordingly, the inside in the axial direction Da for the suction side head 141 is the other side in the axial direction Da and the inside in the axial direction Da for the discharge side head 142 is the one side in the axial direction Da.

In other words, in the suction side head 141, the head seal attachment groove 251 is formed at a position close to the suction side head exterior surface 241 as a position close to the one side in the axial direction Da. In the discharge side head main body 146, the head seal attachment groove 251 is formed at a position close to the discharge side head exterior surface 245 as a position close to the other side in the axial direction Da. The head seal attachment groove 251 may have the same shape as a clearance seal attachment groove 261 (described later).

As illustrated in FIG. 1, the communication clearance seal portion 16 seals a communication clearance C formed between the outer peripheral surface of the diaphragm 13 and the inner peripheral surface of the casing 2. The communication clearance C is formed between the outer peripheral surface of the diaphragm 13 and the inner peripheral surface of the casing 2 in a state where the bundle 10 is accommodated in the casing 2. The communication clearance C is an annular space extending in the axial direction Da for communication between the suction opening 236 and the discharge opening 237.

The communication clearance seal portion 16 according to the present embodiment is an O ring accommodated in the clearance seal attachment groove 261 formed in the outer peripheral surface of the entrance wall 135. Only one communication clearance seal portion 16 is disposed with respect to the communication clearance C. Specifically, the clearance seal attachment groove 261 is formed at a position close to the suction opening 236 in the outer peripheral surface of the entrance wall 135 (position as close as possible to the one side in the axial direction Da). The communication clearance seal portion 16 has an annular shape and is formed over the entire circumference of the upper half diaphragm 131 and the lower half diaphragm 132 that are combined with each other.

Figure 5:
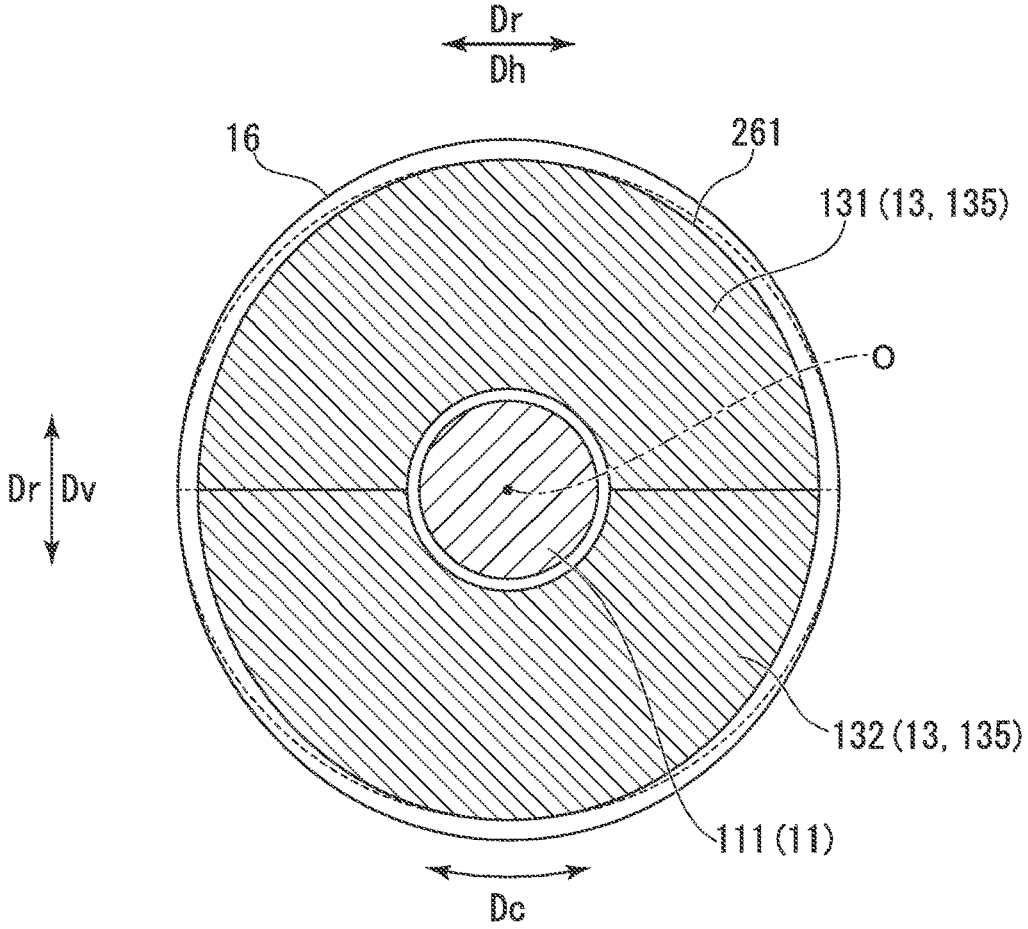
FIG. 5 is a sectional view illustrating a clearance seal attachment groove and a communication clearance seal portion according to the embodiment of the present invention.

As illustrated in FIG. 5, the clearance seal attachment groove 261 is formed to be gradually deeper from the upper vertex of the upper half diaphragm 131 in the vertical direction Dv and the lower vertex of the lower half diaphragm 132 in the vertical direction Dv toward both end positions in the horizontal direction Dh with an angular difference of 90 degrees in the circumferential direction Dc. At the upper vertex of the upper half diaphragm 131 in the vertical direction Dv and the lower vertex of the lower half diaphragm 132 in the vertical direction Dv, the clearance seal attachment groove 261 is formed with a depth allowing the communication clearance seal portion 16 to protrude to the outside in the radial direction Dr beyond the outer peripheral surface of the diaphragm 13. At both ends in the horizontal direction Dh, the clearance seal attachment groove 261 is formed with a depth not allowing the communication clearance seal portion 16 to protrude beyond the outer peripheral surface of the diaphragm 13.

Figure 6:
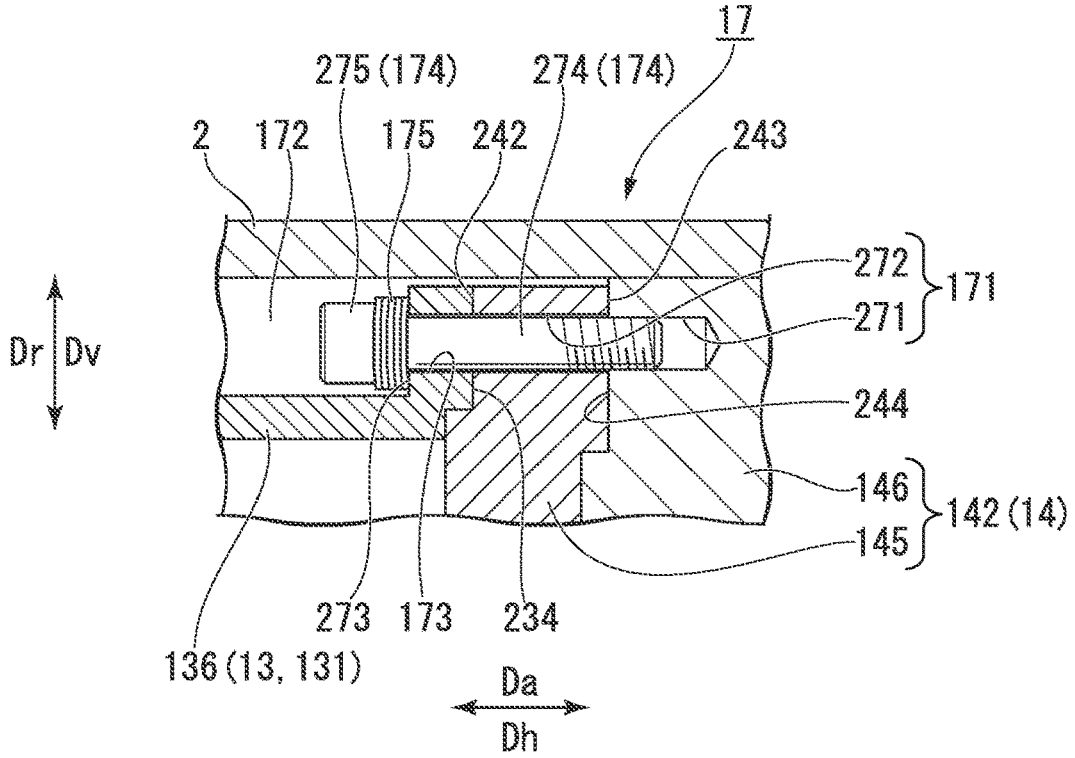
FIG. 6 is an enlarged view of a main part illustrating a fastening portion according to the embodiment of the present invention.

As illustrated in FIG. 1, the fastening portion 17 detachably fixes the discharge side head 142 and the final stage diaphragm 136. A plurality of the fastening portions 17 are disposed equally in the circumferential direction Dc about the axis O with respect to the discharge side head 142. As illustrated in FIG. 6, the fastening portion 17 according to the present embodiment has a fixed hole 171, a bolt attachment groove 172, a fastening through-hole 173, a bolt member 174, and an elastic member 175.

The fixed hole 171 has a fixed screw hole 271 formed in the discharge side head main body 146 and a fixed through-hole 272 formed in the exit wall portion 145.

The fixed screw hole 271 is formed in a discharge side head main body inside surface 244, which is a flat surface of the discharge side head main body 146 and facing the one side in the axial direction Da. The fixed screw hole 271 is a screw hole that has a female screw therein and allows the bolt member 174 to be fixed.

The fixed through-hole 272 penetrates the exit wall portion 145 in the axial direction Da at the same position as the fixed screw hole 271 when seen from the axial direction Da. The fixed through-hole 272 penetrates an exit inside surface 242 facing the one side in the axial direction Da and an exit outside surface 243 facing the other side in the axial direction Da in the exit wall portion 145. The exit inside surface 242 is a flat surface that is in contact with the final stage diaphragm 136 when the discharge side head 142 is fixed to the final stage diaphragm 136. The exit outside surface 243 is a flat surface that is in contact with the discharge side head main body 146 when the exit wall portion 145 is fixed to the discharge side head main body 146.

The bolt attachment groove 172 is recessed from the outer peripheral surface of the final stage diaphragm 136 in a rectangular sectional shape. The bolt attachment groove 172 is formed with a length in the axial direction Da longer than the length of the bolt member 174. A plurality of the bolt attachment grooves 172 are formed apart from each other in the circumferential direction Dc with respect to the outer peripheral surface of the final stage diaphragm 136.

The fastening through-hole 173 is formed in the final stage diaphragm 136. The fastening through-hole 173 is formed at a position overlapping the fixed screw hole 271 and the fixed through-hole 272 when seen from the axial direction Da. The fastening through-hole 173 penetrates a groove inside surface 273 facing the one side in the axial direction Da and a final stage diaphragm contact surface 234 facing the other side in the axial direction Da in the final stage diaphragm 136. The groove inside surface 273 is a part of the flat surface that forms the bolt attachment groove 172. The final stage diaphragm contact surface 234 is a flat surface that is in contact with the exit inside surface 242 when the final stage diaphragm 136 is fixed to the exit wall portion 145.

The bolt member 174 has a shaft portion 274 that has an outer peripheral surface provided with a male screw and a head portion 275 that is formed in an end portion of the shaft portion 274. The shaft portion 274 has a tip fixed to the fixed screw hole 271 in a state where the shaft portion 274 is inserted in the fastening through-hole 173 and the fixed through-hole 272. The head portion 275 is formed with a size allowing the head portion 275 to be accommodated in the bolt attachment groove 172. In other words, the head portion 275 is disposed in the bolt attachment groove 172 in a state where the shaft portion 274 is fixed to the fixed screw hole 271.

The elastic member 175 is a plurality of belleville spring washers disposed between the head portion 275 and the groove inside surface 273. The elastic member 175 is stacked in the form of a plurality of sheets. The elastic member 175 is sandwiched by the groove inside surface 273 and the surface of the head portion 275 that faces the other side in the axial direction Da, in a state where the shaft portion 274 is inserted.

As illustrated in FIG. 1, the regulating portion 18 is disposed in at least one of the casing 2 and the head 14. The regulating portion 18 regulates the position of the head 14 in the axial direction Da with respect to the casing 2. The regulating portion 18 according to the first embodiment is disposed over both the casing 2 and the head 14. The regulating portion 18 is disposed with respect to each of the suction side head 141 and the discharge side head 142. Specifically, as illustrated in FIG. 4, the regulating portion 18 has a fitting recessed portion 181 formed in the inner peripheral surface of the casing 2 and a fitting projecting portion 182 formed on the outer peripheral surfaces of the suction side head 141 and the discharge side head main body 146 and fitting into the fitting recessed portion 181.

FIG. 4 is an enlarged view of a main part showing the regulating portion 18 disposed between the suction side head 141 and the upper half casing 21. Although the regulating portion 18 is disposed to correspond to each of the suction side head 141 and the discharge side head 142, the regulating portion 18 around the suction side head 141 will be described below as an example with reference to FIG. 4.

The fitting recessed portion 181 is recessed over the entire circumference with a rectangular sectional shape from the inner peripheral surface of the casing 2. Two fitting recessed portions 181 are formed, apart from each other in the axial direction Da, to correspond to the position where the suction side head 141 is disposed. The fitting recessed portion 181 is formed in each of the upper half casing 21 and the lower half casing 22.

The fitting projecting portion 182 protrudes over the entire circumference with a rectangular sectional shape from the outer peripheral surface of the suction side head 141. The fitting projecting portion 182 is formed inside the head seal attachment groove 251 in the axial direction Da. Two fitting projecting portions 182 are formed to be aligned in the axial direction Da with respect to the suction side head 141.

Figure 7:
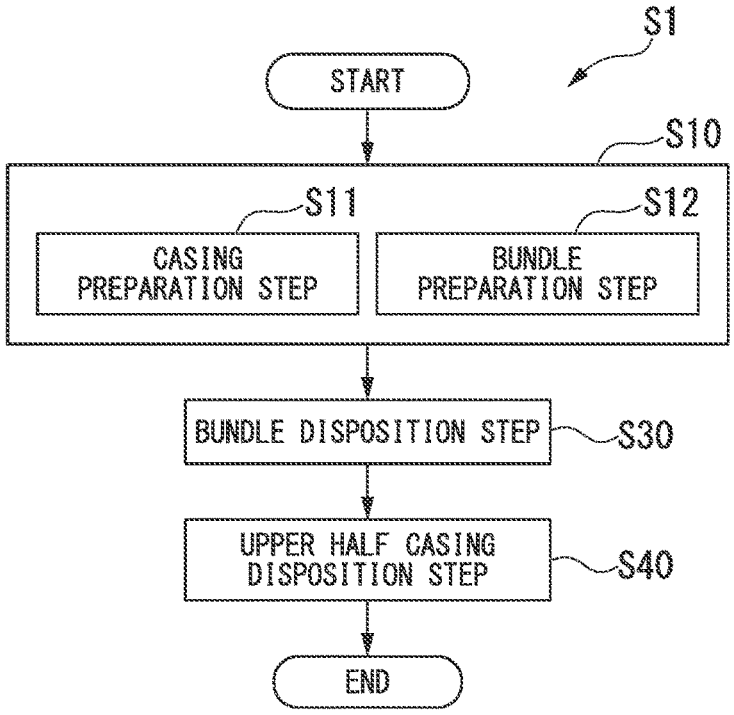
FIG. 7 is a flow diagram showing a compressor-manufacturing method according to the first embodiment of the present invention.

A compressor-manufacturing method S1 according to the first embodiment will be described below. As illustrated in FIG. 7, the compressor-manufacturing method S1 according to the present embodiment includes a preparation step S10, a bundle disposition step S30, and an upper half casing disposition step S40.

In the preparation step S10, parts necessary for manufacturing the compressor 1 are prepared. In the preparation step S10 according to the first embodiment, a casing preparation step S11 and a bundle preparation step S12 are carried out simultaneously.

In the preparation step S10, the lower half casing 22 and the upper half casing 21 where the fitting recessed portion 181 is formed are manufactured and prepared. In addition, in the preparation step S10, each of the rotor 11, the bearing portion 12, the upper half diaphragm 131, the lower half diaphragm 132, the suction side head 141, the discharge side head 142, the communication clearance seal portion 16, and the fastening portion 17 is prepared by, for example, manufacturing.

In the preparation step S10, the diaphragm 13 is annularly formed, with the rotor 11 disposed therein, by the upper half diaphragm 131 being fixed onto the lower half diaphragm 132 by fixing means such as a bolt. Subsequently, the welding portion 231 is formed by the outer peripheral surfaces of the diaphragms 13 disposed to be adjacent to each other being welded. As a result, the plurality of diaphragms 13 are integrated. The communication clearance seal portion 16 is attached to the outer peripheral surfaces of the integrated diaphragms 13. Subsequently, the head seal portion 15 is attached to each of the discharge side head 142 and the suction side head 141 where the fitting projecting portion 182 is formed. In addition, the bearing portion 12 is fixed to the suction side head 141 and the discharge side head 142. Subsequently, the suction side head 141 is fixed to the diaphragm 13 by the bolt member 170. In addition, the discharge side head 142 is fixed to the diaphragm 13 by the fastening portion 17. As a result, the bundle 10 as a single integrated part is prepared.

Figure 8:
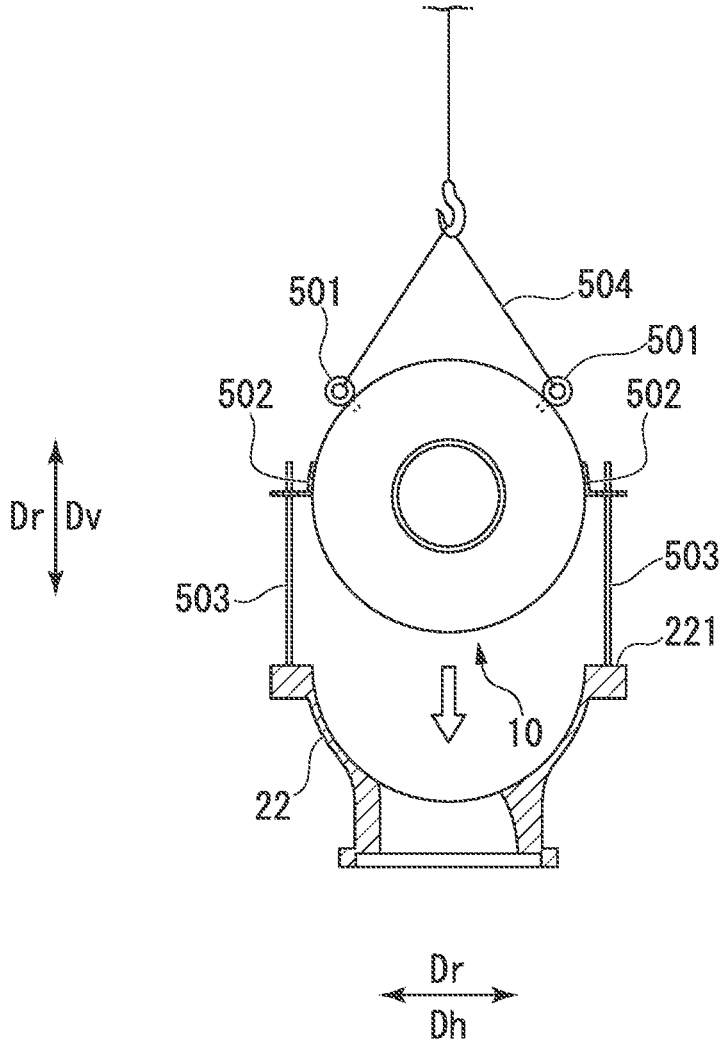
FIG. 8 is a schematic diagram illustrating a bundle disposition step of the compressor-manufacturing method according to the first embodiment of the present invention.
Figure 9:
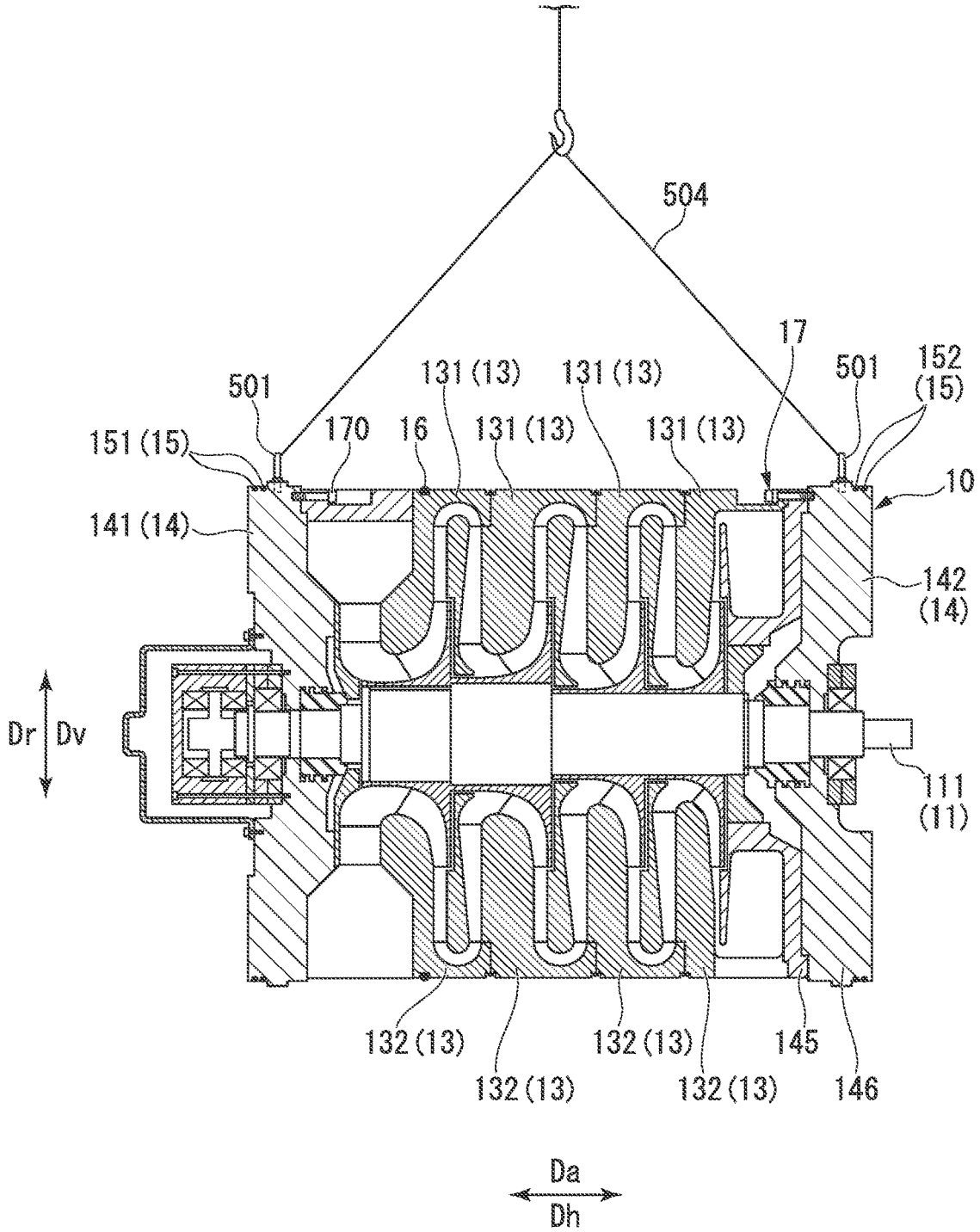
FIG. 9 is a sectional view illustrating an eye bolt attachment position during a bundle movement.

In the bundle disposition step S30, the bundle 10 is disposed from above in the vertical direction Dv with respect to the lower half casing 22 as illustrated in FIG. 8. An eye bolt 501 is fixed beforehand to the outer peripheral surface of the bundle 10. In the present embodiment, the eye bolt 501 is attached in two places on the outer peripheral surface of the suction side head 141 and in two places on the outer peripheral surface of the discharge side head 142 as illustrated in FIG. 9. The eye bolt 501 is attached at a position with an angular difference of 45 degrees in the circumferential direction Dc from the upper end in the vertical direction Dv. In addition, as illustrated in FIG. 8, a plurality of rod-shaped guide rods 502 are attached to the lower half casing 22 to extend upward in the vertical direction Dv from the lower half casing-divided surface 221. By the guide rod 502 being inserted, a guide plate 503 that can be guided along the guide rod 502 is attached to the bundle 10. The guide plate 503 is attached to the outer peripheral surface of the diaphragm 13 to correspond to the position where the guide rod 502 is disposed.

In the bundle disposition step S30, a wire 504 is fixed to the eye bolt 501. By the wire 504 being rolled up by means of a crane, the bundle 10 is temporarily lifted upward in the vertical direction Dv. Subsequently, the horizontal position of the bundle 10 is adjusted such that the guide rod 502 is inserted into the guide plate 503, and the bundle 10 is lowered. As a result, the bundle 10 is lowered along the guide rod 502.

Once the bundle 10 is lowered to the vicinity of the lower half casing 22, each of the guide plates 503 is removed from the bundle 10 and each of a pair of the guide rods 502 is removed from the lower half casing 22. Subsequently, the bundle 10 is lowered to the inner peripheral surface of the lower half casing 22. When the bundle 10 is disposed in the lower half casing 22, the bundle 10 is lowered such that the fitting projecting portion 182 formed on the suction side head 141 and the fitting projecting portion 182 formed on the discharge side head main body 146 fit into the fitting recessed portion 181 formed in the lower half casing 22. As a result, a state occurs where the positions of the suction side head 141 and the discharge side head main body 146 in the axial direction Da are regulated with respect to the lower half casing 22. Furthermore, the communication clearance C is formed between the outer peripheral surface of the lower half diaphragm 132 and the inner peripheral surface of the lower half casing 22. The communication clearance C is sealed by the communication clearance seal portion 16 in contact with the inner peripheral surface of the lower half casing 22.

Figure 10:
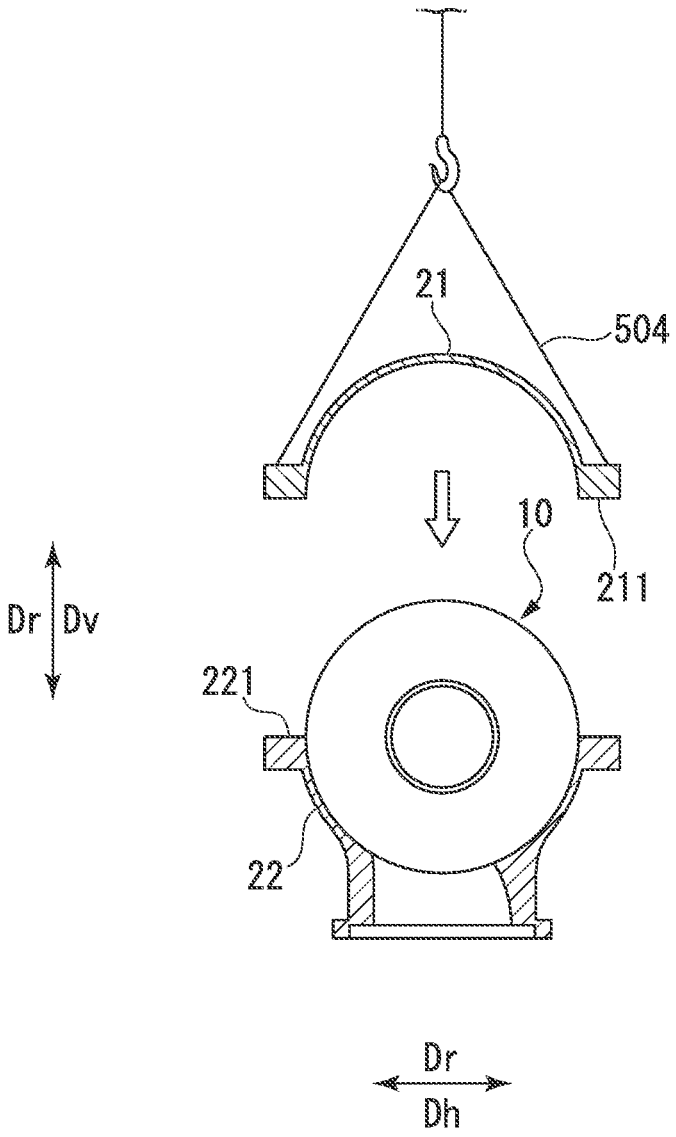
FIG. 10 is a schematic diagram illustrating an upper half casing disposition step of the compressor-manufacturing method according to the first embodiment of the present invention.

The upper half casing disposition step S40 is carried out after the bundle disposition step S30. In the upper half casing disposition step S40, the upper half casing 21 is disposed from above in the vertical direction Dv with respect to the bundle 10 fitting into the lower half casing 22 as illustrated in FIG. 10. The wire 504 is fixed to the flange of the upper half casing 21. By the wire 504 being rolled up by means of a crane, the upper half casing 21 is temporarily lifted upward in the vertical direction Dv. Subsequently, the upper half casing 21 is lowered above the bundle 10.

Once the upper half casing 21 is lowered to the vicinity of the lower half casing 22, the horizontal position is adjusted such that the bundle 10 is accommodated in the inner peripheral surface of the upper half casing 21. When the bundle 10 is disposed in the upper half casing 21, the upper half casing 21 is lowered such that the fitting projecting portion 182 formed on the suction side head 141 and the fitting projecting portion 182 formed on the discharge side head main body 146 fit into the fitting recessed portion 181 formed in the upper half casing 21. As a result, a state occurs where the positions of the suction side head 141 and the discharge side head main body 146 in the axial direction Da are regulated with respect to the upper half casing 21. Furthermore, the communication clearance C is formed between the outer peripheral surface of the upper half diaphragm 131 and the inner peripheral surface of the upper half casing 21. The communication clearance C is sealed by the communication clearance seal portion 16 in contact with the inner peripheral surface of the upper half casing 21. Subsequently, the compressor 1 is completed by fixing means fixing the upper half casing 21 and the lower half casing 22 in a state where the upper half casing-divided surface 211 abuts against the lower half casing-divided surface 221.

According to the compressor 1 and the compressor-manufacturing method S1 as described above, the communication clearance C formed between the outer peripheral surface of the diaphragm 13 and the inner peripheral surface of the casing 2 for communication between the suction opening 236 and the discharge opening 237 is sealed by the communication clearance seal portion 16. By the communication clearance C being formed between the outer peripheral surface of the diaphragm 13 and the inner peripheral surface of the casing 2, interference or the like during assembly of the bundle 10 and the casing 2 that has the vertically divided structure can be prevented and assemblability can be improved. Furthermore, by the communication clearance C being sealed, a high-pressure process gas supplied to the discharge opening 237 can be prevented from leaking out from the suction opening 236 through the communication clearance C. As a result, leakage between the inner peripheral surface of the casing 2 and the outer peripheral surface of the diaphragm 13 can be reduced.

In addition, the communication clearance seal portion 16 is disposed only in one place in the outer peripheral surface of the entrance wall 135 in the communication clearance C. Accordingly, a high-pressure process gas flowing into the communication clearance C from the discharge opening 237 flows in to the position where the communication clearance seal portion 16 is disposed. Accordingly, the pressure around the outer peripheral surface of the diaphragm 13 as a whole increases. Accordingly, a surface pressure is applied to the divided surface of the casing 2 that has the vertically divided structure, and the sealability in each of the diaphragms 13 can be improved.

In addition, as the regulating portion 18, the fitting recessed portion 181 formed in the inner peripheral surface of the casing 2 and the fitting projecting portion 182 formed on the outer peripheral surfaces of the suction side head 141 and the discharge side head main body 146 are disposed. Accordingly, the position of the head 14 in the axial direction Da with respect to the casing 2 can be regulated with a simple structure forming a simple uneven shape. In addition, the regulating portion 18 regulating the position of the head 14 in the axial direction Da with respect to the casing 2 is directly formed as a part of the head 14 and the casing 2 instead of as a separate member. Furthermore, the fitting recessed portion 181 and the fitting projecting portion 182 are the only structures regulating the positions of the bundle 10 and the casing 2 in the axial direction Da and the diaphragm 13 lacks a structure regulating the positions of the bundle 10 and the casing 2 in the axial direction Da. Accordingly, the number of parts to be assembled and positioning places in the axial direction Da decrease and adjustment during assembly of the casing 2 and the bundle 10 is facilitated. As a result, assemblability can be further improved.

Both ends of the diaphragm 13 in the horizontal direction Dh are close to the divided surface of the casing 2. Accordingly, once the protruding amount of the communication clearance seal portion 16 increases at both ends in the horizontal direction Dh, damage may arise, by an O ring being sandwiched by the divided surface or being rubbed against an edge, when the upper half casing 21 is attached to the lower half casing 22. The clearance seal attachment groove 261, however, is formed to become deep toward both ends in the horizontal direction Dh. Accordingly, the communication clearance seal portion 16 fitting into the clearance seal attachment groove 261 has a protruding amount from the outer peripheral surface of the diaphragm 13 that decreases from the upper vertex in the vertical direction Dv and the lower vertex in the vertical direction Dv toward both ends in the horizontal direction Dh. As a result, damage to the O ring as the communication clearance seal portion 16 at a time when the upper half casing 21 is attached to the lower half casing 22 can be reduced. In particular, with the clearance seal attachment groove 261 according to the present embodiment, the protruding amount of the communication clearance seal portion 16 is the least at both ends in the horizontal direction Dh. Accordingly, damage to the communication clearance seal portion 16 at a time when the upper half casing 21 is attached to the lower half casing 22 can be more effectively reduced.

In addition, during an operation of the compressor 1, a process gas increased in temperature and pressure as a result of compression may circulate in the vicinity of the discharge opening 237, and this circulation may result in heating of the final stage diaphragm 136 and the exit wall portion 145 and heat extension in the axial direction Da. In this case, in the bolt member 174 with a tip fixed to the fixed through-hole 272, the final stage diaphragm 136 and the exit wall portion 145 extend in the axial direction Da between the head portion 275 and the tip. As a result, a force causing pulling in the axial direction Da acts on the boundary between the head portion 275 and the shaft portion 274 of the bolt member 174. In a case where deformation in the axial direction Da occurs in the final stage diaphragm 136 and the exit wall portion 145, however, the force acting on the head portion 275 is absorbed by compression of the plurality of belleville spring washers as the elastic member 175 pinched between the head portion 275 and the groove inside surface 273. As a result, damage such as breakage of the bolt member 174 between the shaft portion 274 and the head portion 275 can be forestalled.

The use of the fastening portion 17 is not limited to fixing of the discharge side head 142 and the final stage diaphragm 136. For example, in the first embodiment, the fastening portion 17 may also be used for fixing of the suction side head 141 and the entrance wall 135.

In addition, the elastic member 175 in the fastening portion 17 is not limited to being the belleville spring washer. The elastic member 175 may also be a rubber material or a spring member.

In addition, the fixed hole 171 in the fastening portion 17 is not limited to a structure formed in the discharge side head 142. For example, the fixed hole 171 may also be formed in the final stage diaphragm 136.

In addition, fixing means other than welding may also be used for fixing between the adjacent diaphragms 13. In addition, although four diaphragms 13 are disposed in the present embodiment, the number of the diaphragms 13 is not limited thereto and an appropriate change in design is possible in accordance with the number of stages of the impeller 112.

The communication clearance seal portion 16 is not limited to being disposed in the outer peripheral surface of the diaphragm 13 as a part of the bundle 10. The communication clearance seal portion 16 may also be disposed on the casing 2 side or as a separate member insofar as the communication clearance seal portion 16 is capable of sealing the communication clearance C.

Second Embodiment

Hereinafter, a second embodiment of the compressor according to the present invention will be described with reference to FIGS. 11 and 12. A compressor 1A according to the second embodiment differs from the first embodiment in terms of the structure of the regulating portion. Accordingly, in the following description of the second embodiment, the same reference numerals will be used to refer to the same parts as in the first embodiment and repetitive description will be omitted.

Figure 11:
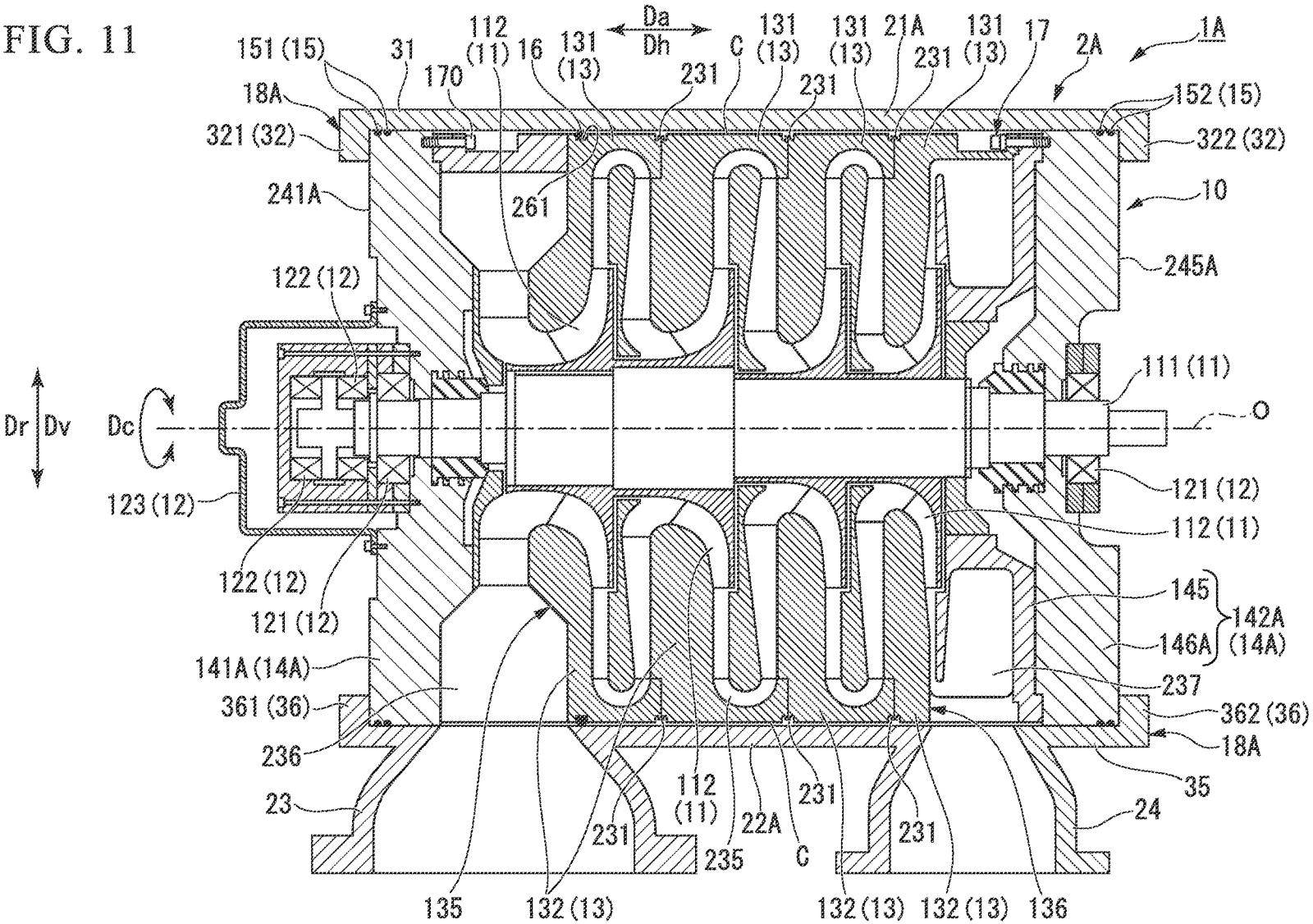
FIG. 11 is a sectional view schematically illustrating the configuration of a compressor according to a second embodiment of the present invention.

As illustrated in FIG. 11, in the compressor 1A according to the second embodiment, a regulating portion 18A is disposed in a casing 2A. In the casing 2A according to the second embodiment, an upper half casing 21A has an upper half casing main body 31 and an upper half protruding portion 32. In addition, a lower half casing 22A has a lower half casing main body 35 and a lower half protruding portion 36. The upper half protruding portion 32 and the lower half protruding portion 36 constitute the regulating portion 18A according to the present embodiment. In other words, the regulating portion 18A according to the second embodiment is formed only in the casing 2A.

The upper half casing main body 31 extends in the axial direction Da with a section orthogonal to the axis O having a semicircular ring shape about the axis O. The upper half casing main body 31 is open downward in the vertical direction Dv such that the bundle 10 fits in the upper half casing main body 31. As a result, the upper half casing main body 31 covers the upper side of the outer peripheral surface of the bundle 10 accommodated in the upper half casing main body 31. The upper half casing main body 31 has the upper half casing-divided surface 211 at both ends in the circumferential direction Dc. In other words, the upper half casing main body 31 has the same shape as the upper half casing 21 according to the first embodiment.

The lower half casing main body 35 extends in the axial direction Da with a section orthogonal to the axis O having a semicircular ring shape about the axis O. The lower half casing main body 35 is open upward in the vertical direction Dv such that the bundle 10 fits in the lower half casing main body 35. As a result, the lower half casing main body 35 covers the lower side of the outer peripheral surface of the bundle 10 accommodated in the lower half casing main body 35. The lower half casing main body 35 has the lower half casing-divided surface 221 at both ends in the circumferential direction Dc. In other words, the lower half casing main body 35 has the same shape as the lower half casing 22 according to the first embodiment. Accordingly, the lower half casing main body 35 is formed in a tubular shape, with both ends open, by the lower half casing 22A and the upper half casing 21A being combined with each other.

The upper half protruding portions 32 are respectively formed at both ends of the upper half casing main body 31 in the axial direction Da. The upper half protruding portion 32 protrudes from the upper half casing main body 31 toward the inside in the radial direction Dr to have a semi-annular shape when seen from the axial direction Da. Specifically, the upper half protruding portion 32 has a first upper half protruding portion 321 disposed on the outside in the axial direction Da with respect to a suction side head 141A and a second upper half protruding portion 322 disposed on the outside in the axial direction Da with respect to a discharge side head 142A.

The first upper half protruding portion 321 is formed in the end portion of the upper half casing main body 31 that is on the one side in the axial direction Da. As illustrated in FIG. 12, the surface of the first upper half protruding portion 321 that faces the other side in the axial direction Da is in contact with a suction side head exterior surface 241A, which is the end surface of the suction side head 141A that faces the outside in the axial direction Da.

As illustrated in FIG. 11, the second upper half protruding portion 322 is formed in the end portion of the upper half casing main body 31 that is on the other side in the axial direction Da. The surface of the second upper half protruding portion 322 that faces the one side in the axial direction Da is in contact with a discharge side head exterior surface 245A, which is the end surface of a discharge side head main body 146A that faces the outside in the axial direction Da.

The lower half protruding portions 36 are respectively formed at both ends of the lower half casing main body 35 in the axial direction Da. The lower half protruding portion 36 protrudes from the lower half casing main body 35 toward the inside in the radial direction Dr to have a semi-annular shape when seen from the axial direction Da. Specifically, the lower half protruding portion 36 has a first lower half protruding portion 361 disposed on the outside in the axial direction Da with respect to the suction side head 141A and a second lower half protruding portion 362 disposed on the outside in the axial direction Da with respect to the discharge side head 142A.

The first lower half protruding portion 361 is formed in the end portion of the lower half casing main body 35 that is on the one side in the axial direction Da. The surface of the first lower half protruding portion 361 that faces the other side in the axial direction Da is in contact with the suction side head exterior surface 241A, which is the end surface of the suction side head 141A that faces the outside in the axial direction Da. The surface of the first lower half protruding portion 361 that faces the other side in the axial direction Da is formed at a position that has the same position in the axial direction Da as the surface of the first upper half protruding portion 321 that faces the other side in the axial direction Da.

The second lower half protruding portion 362 is formed in the end portion of the lower half casing main body 35 that is on the other side in the axial direction Da. The surface of the second lower half protruding portion 362 that faces the one side in the axial direction Da is in contact with the discharge side head exterior surface 245A, which is the end surface of the discharge side head 142A that faces the outside in the axial direction Da. The surface of the second lower half protruding portion 362 that faces the one side in the axial direction Da is formed at a position that has the same position in the axial direction Da as the surface of the second upper half protruding portion 322 that faces the one side in the axial direction Da.

Figure 12:
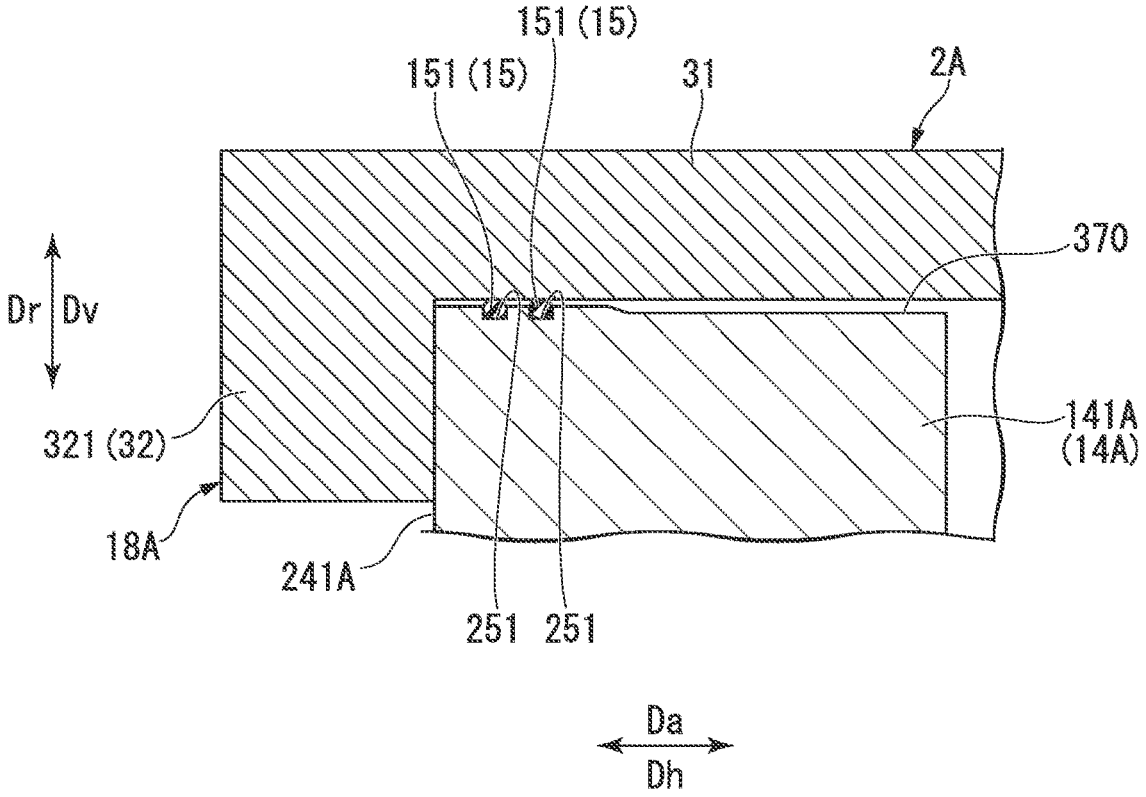
FIG. 12 is an enlarged view of a main part illustrating a regulating portion according to the second embodiment of the present invention.

In addition, as illustrated in FIG. 12, a head 14A according to the second embodiment is not provided with the fitting projecting portion 182. A clearance enlarged recessed portion 370 is formed inside the head seal attachment groove 251 in the axial direction Da in the outer peripheral surface of the head 14A (on the side where the diaphragm 13 is disposed with respect to the head 14A). The clearance enlarged recessed portion 370 is recessed from the outer peripheral surface of the head 14A for a larger clearance with respect to the inner peripheral surface of the casing 2A.

According to the compressor 1A as described above, the positions of the suction side head 141A and the discharge side head 142A in the axial direction Da with respect to the casing 2A can be regulated at a part positioned outside the compressor 1A by the upper half protruding portion 32 and the lower half protruding portion 36. The upper half protruding portion 32 and the lower half protruding portion 36 are unlikely to be limited in terms of space since the upper half protruding portion 32 and the lower half protruding portion 36 are positioned outside the compressor 1A. Accordingly, depending on the type of a process gas to be compressed, the upper half protruding portion 32 and the lower half protruding portion 36 can be enlarged, even in a case where a large thrust force is generated in the bundle 10, in accordance with the force that is generated in the bundle 10. As a result, the position of the bundle 10 with respect to the casing 2A can be stably held. In addition, regulation of the position of the bundle 10 with respect to the casing 2A can be confirmed at a position visible from the outside.

Third Embodiment

Hereinafter, a third embodiment of the compressor according to the present invention will be described with reference to FIGS. 13 and 14. A compressor 1B according to the third embodiment differs from the first and second embodiments in terms of the structure of the regulating portion. Accordingly, in the following description of the third embodiment, the same reference numerals will be used to refer to the same parts as in the first and second embodiments and repetitive description will be omitted.

Figure 13:
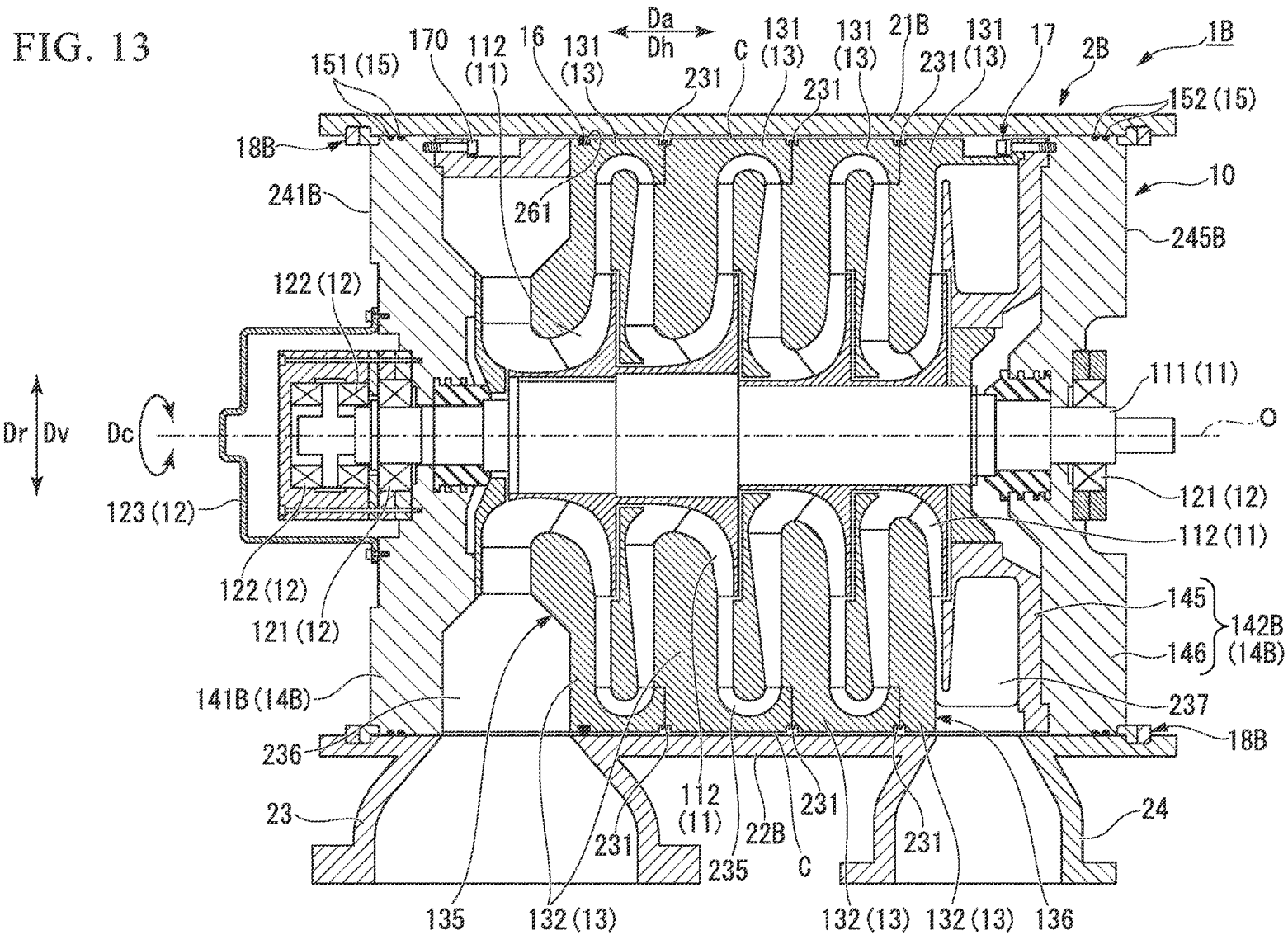
FIG. 13 is a sectional view schematically illustrating the configuration of a compressor according to a third embodiment of the present invention.

As illustrated in FIG. 13, in the compressor 1B according to the third embodiment, both ends of a casing 2B are formed to protrude to the outside in the axial direction Da beyond a suction side head 141B and a discharge side head 142B. In other words, the length of the casing 2B according to the third embodiment in the axial direction Da is formed to be longer than the distance from a suction side head exterior surface 241B to a discharge side head exterior surface 245B in the axial direction Da.

A regulating portion 18B according to the third embodiment has separate members other than the casing 2B and a head 14B. Specifically, the regulating portion 18B has a regulating accommodating recessed portion 410, a head regulating accommodating groove 420, a first regulating member 430, and a second regulating member 440.

Figure 14:
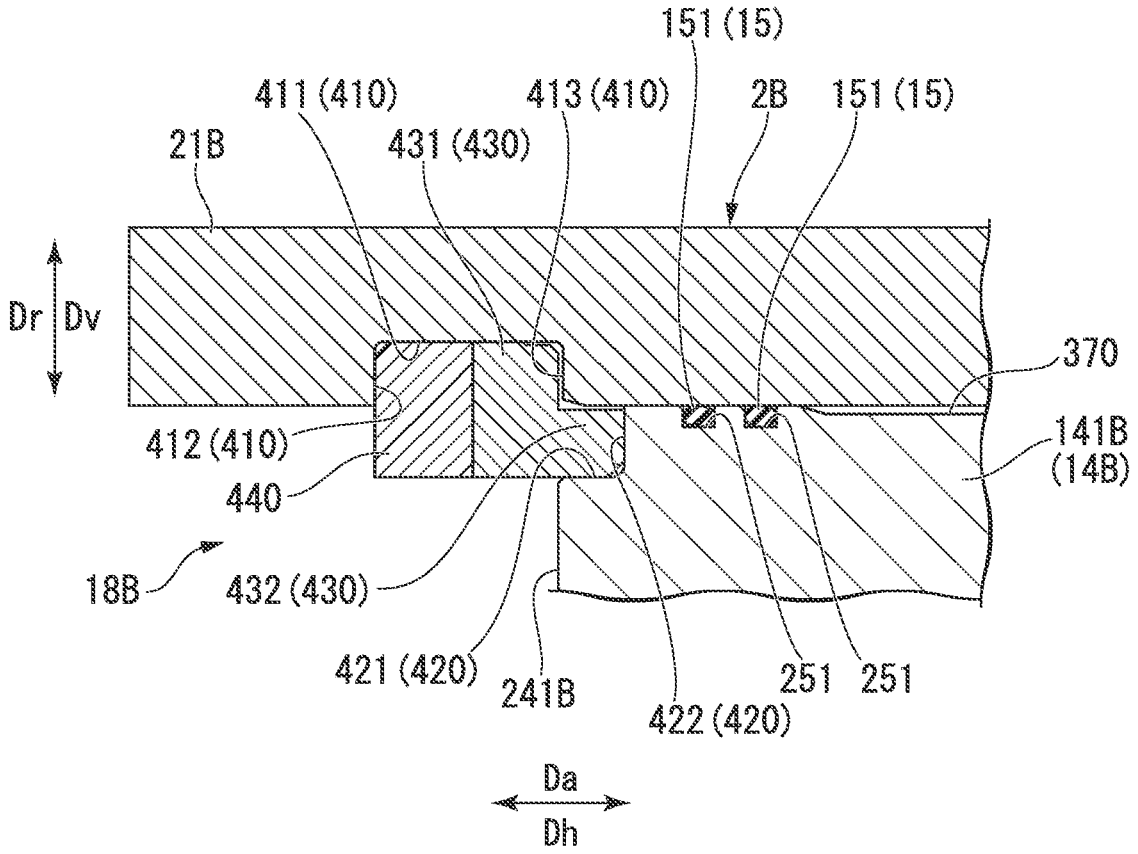
FIG. 14 is an enlarged view of a main part illustrating a regulating portion according to the third embodiment of the present invention.

FIG. 14 is an enlarged view of a main part showing the regulating portion 18B disposed between the suction side head 141B and an upper half casing 21B. Although the regulating portion 18B according to the third embodiment is disposed to correspond to each of the suction side head 141B and the discharge side head 142B, the regulating portion 18B around the suction side head 141B will be described below as an example with reference to FIG. 14.

The regulating accommodating recessed portion 410 is formed at the part of the end portion of the casing 2B that protrudes to the outside in the axial direction Da beyond the suction side head 141B. The regulating accommodating recessed portion 410 is recessed with a rectangular sectional shape from the inner peripheral surface of the casing 2B such that a part of the regulating accommodating recessed portion 410 is positioned on the outside in the axial direction Da with respect to the suction side head 141B. A regulating accommodating recessed portion bottom surface 411 facing the inside in the radial direction Dr, a regulating accommodating recessed portion first surface 412 facing the inside the axial direction Da, and a regulating accommodating recessed portion second surface 413 facing the outside in the axial direction Da constitute the regulating accommodating recessed portion 410. The regulating accommodating recessed portion bottom surface 411 is a surface parallel to the inner peripheral surface of the casing 2B. The regulating accommodating recessed portion first surface 412 is a flat surface connecting the inner peripheral surface of the casing 2B and the short side of the regulating accommodating recessed portion bottom surface 411 that is on the outside in the axial direction Da to each other. The regulating accommodating recessed portion second surface 413 is a flat surface connecting the inner peripheral surface of the casing 2B and the short side of the regulating accommodating recessed portion bottom surface 411 that is on the inside in the axial direction Da to each other.

The head regulating accommodating groove 420 is formed in the corner portion that is formed by the outer peripheral surface of the suction side head 141B and the suction side head exterior surface 241B (surface facing the outside in the axial direction Da). The head regulating accommodating groove 420 is formed outside the head seal attachment groove 251 in the axial direction Da. A regulating accommodating groove first surface 421 facing the outside in the radial direction Dr and a regulating accommodating groove second surface 422 facing the outside in the axial direction Da constitute the head regulating accommodating groove 420. The regulating accommodating groove first surface 421 is a surface parallel to the outer peripheral surface of the suction side head 141B and is connected to the suction side head exterior surface 241B. The regulating accommodating groove second surface 422 is a flat surface parallel to the suction side head exterior surface 241B and is a surface connecting the outer peripheral surface of the suction side head 141B and the regulating accommodating groove first surface 421 to each other.

The first regulating member 430 is a member regulating the position of the suction side head 141B in the axial direction Da with respect to the casing 2B by being accommodated in the regulating accommodating recessed portion 410 with the second regulating member 440. The first regulating member 430 has an L-shaped section. Specifically, in the first regulating member 430, a first accommodating portion 431 accommodated in the regulating accommodating recessed portion 410 and a second accommodating portion 432 accommodated in the head regulating accommodating groove 420 are integrally formed.

The first accommodating portion 431 has a rectangular shape. The second accommodating portion 432 is formed to protrude from the first accommodating portion 431 toward the inside in the axial direction with a rectangular shape.

The second regulating member 440 is accommodated in the regulating accommodating recessed portion 410 in a state where the second regulating member 440 is adjacent to the first regulating member 430 outside the first regulating member 430 in the axial direction Da. The second regulating member 440 has a rectangular shape.

When the first regulating member 430 and the second regulating member 440 as described above are attached, the first regulating member 430 is moved to the inside in the axial direction Da in a state where the first accommodating portion 431 is inserted in the regulating accommodating recessed portion 410 and the second accommodating portion 432 is inserted into the head regulating accommodating groove 420. Subsequently, the second regulating member 440 is press-fitted into the regulating accommodating recessed portion 410 on the outside in the axial direction Da with respect to the first regulating member 430. As a result, the first regulating member 430 and the second regulating member 440 are in contact with each other in a state where the first regulating member 430 and the second regulating member 440 are accommodated in the regulating accommodating recessed portion 410 and the head regulating accommodating groove 420. A state then occurs where the second accommodating portion 432 is in contact with the regulating accommodating groove second surface 422 and the second regulating member 440 is in contact with the regulating accommodating recessed portion first surface 412. As a result, the first regulating member 430 and the second regulating member 440 become unremovable by being sandwiched by the regulating accommodating recessed portion first surface 412 and the regulating accommodating groove second surface 422.

According to the compressor 1B as described above, the first regulating member 430 and the second regulating member 440 are accommodated in the regulating accommodating recessed portion 410 and the head regulating accommodating groove 420. As a result, the positions of the suction side head 141B and the discharge side head 142B in the axial direction Da with respect to the casing 2B can be regulated from the outside of the compressor 1B. Furthermore, the first regulating member 430 and the second regulating member 440 can be attached from the outside after the upper half casing 21B is installed on the bundle 10. Accordingly, the positions of the bundle 10, a lower half casing 22B, and the upper half casing 21B in the axial direction Da do not have to be finely adjusted in a case where the bundle 10 is installed in the lower half casing 22B and in a case where the upper half casing 21B is installed on the bundle 10. As a result, assemblability can be improved even more.

Fourth Embodiment

Hereinafter, a fourth embodiment of the compressor according to the present invention will be described with reference to FIGS. 15 to 17. A compressor 1C according to the fourth embodiment differs from the first embodiment in terms of the configuration of the head seal portion. Accordingly, in the following description of the fourth embodiment, the same reference numerals will be used to refer to the same parts as in the first to third embodiments and repetitive description will be omitted.

Figure 15:
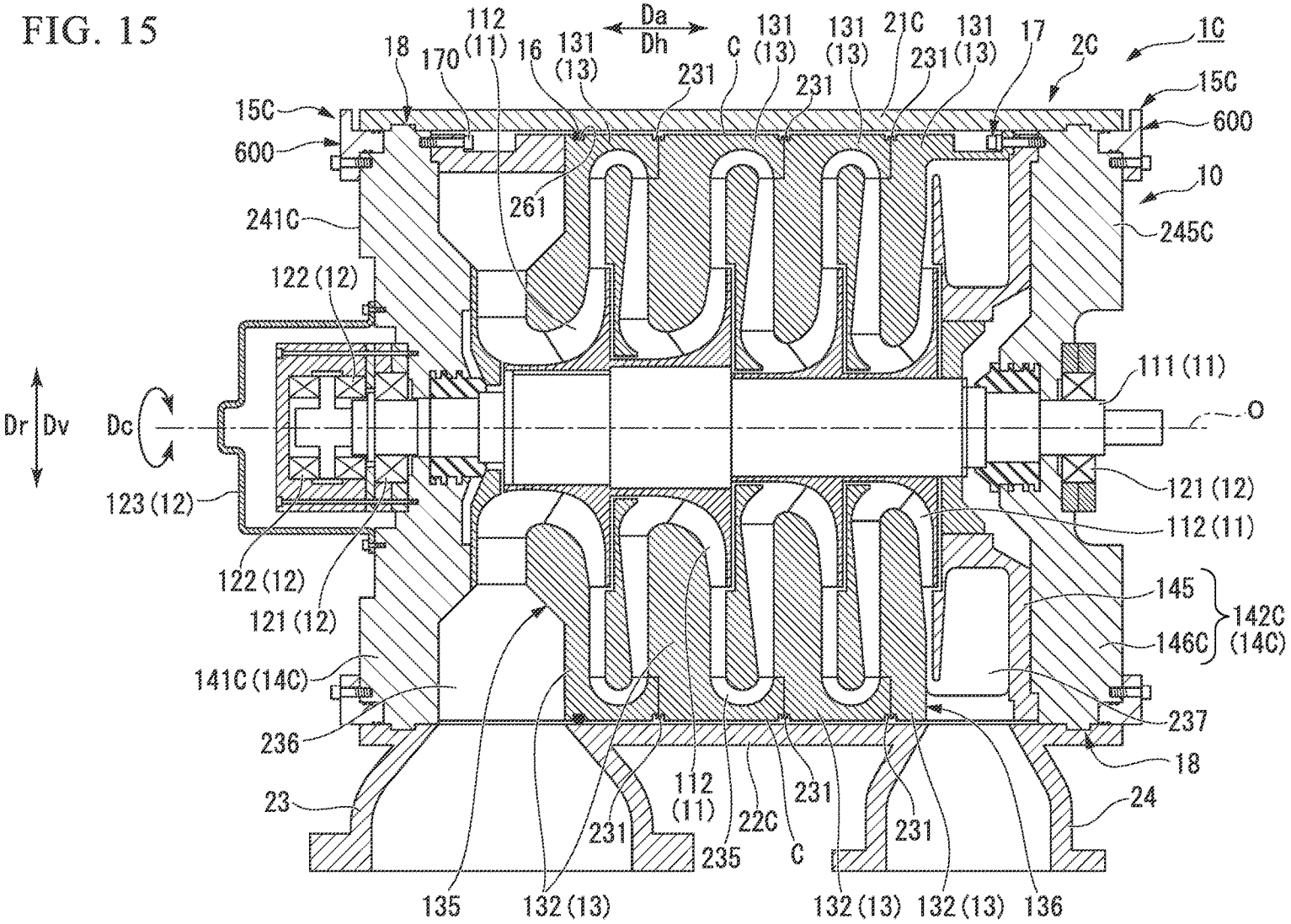
FIG. 15 is a sectional view schematically illustrating the configuration of a compressor according to a fourth embodiment of the present invention.

As illustrated in FIG. 15, the compressor 1C according to the fourth embodiment is provided with a head seal portion 15C that has separate members for sealing between a head 14C and a casing 2C. As illustrated in FIG. 16, the head seal portion 15C according to the fourth embodiment has a seal ring 600, a seal ring-fixing hole 650, a ring insertion groove 660, and an inside ring seal portion 670.

Figure 16:
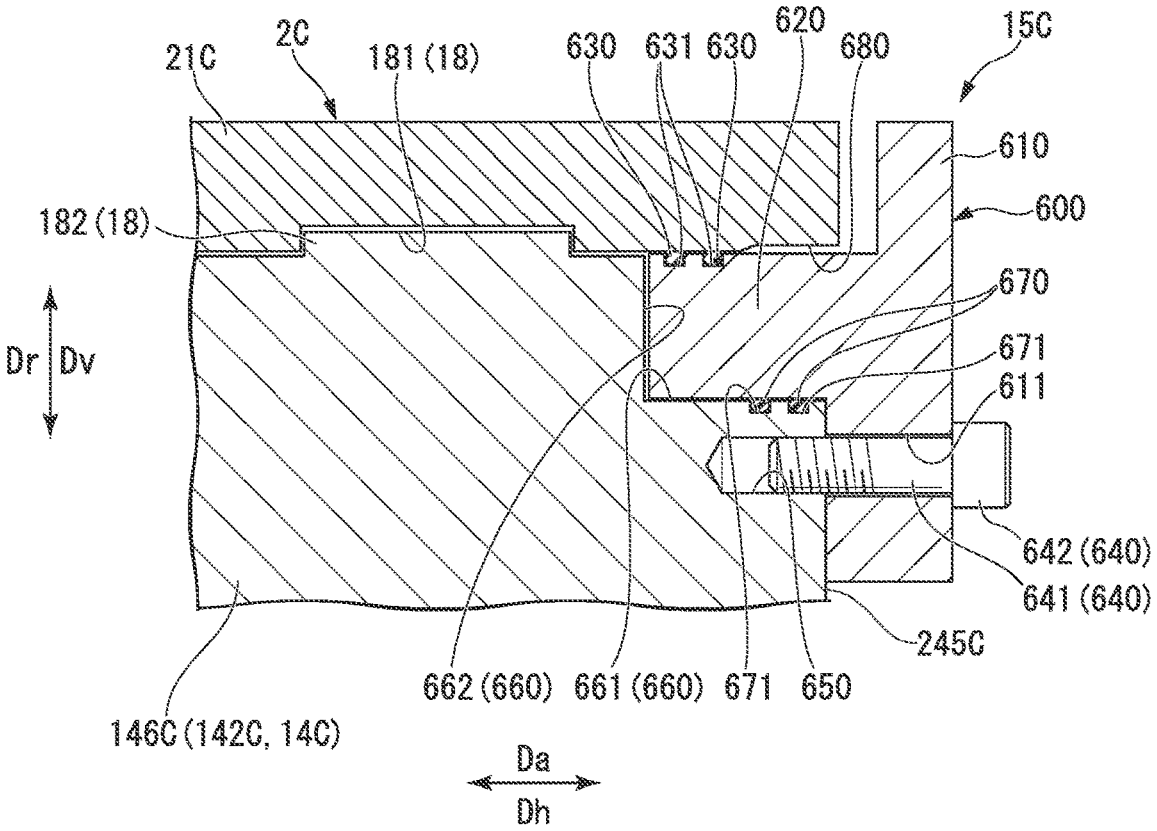
FIG. 16 is an enlarged view of a main part illustrating a head seal portion according to the fourth embodiment of the present invention.
Figure 17:
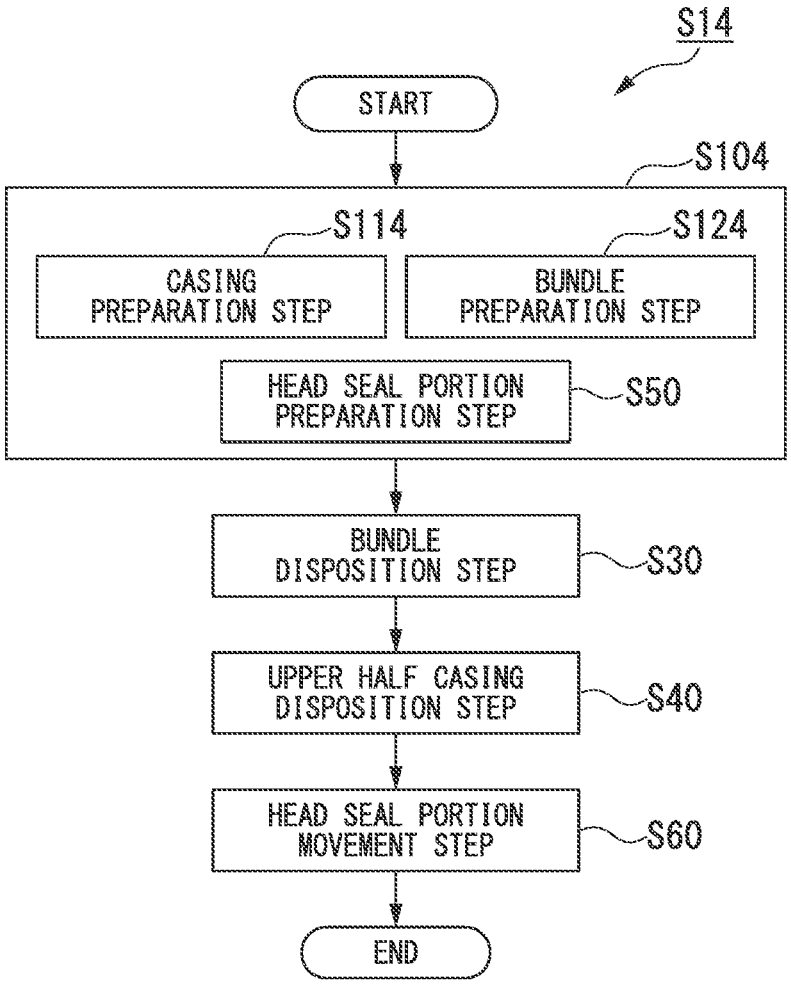
FIG. 17 is a flow diagram showing a compressor-manufacturing method according to the fourth embodiment of the present invention.

FIG. 16 is an enlarged view of a main part showing the head seal portion 15C disposed between a discharge side head 142C and an upper half casing 21C. Although the head seal portion 15C according to the fourth embodiment is disposed to correspond to each of a suction side head 141C and the discharge side head 142C, the head seal portion 15C around the discharge side head 142C will be described below as an example with reference to FIG. 16.

The seal ring 600 is detachable from the outside in the axial direction Da with respect to a discharge side head main body 146C. In other words, the seal ring 600 is movable in the axial direction Da from the outside of the discharge side head main body 146C and the casing 2C. The seal ring 600 is attached from the outside after the casing 2C is attached to the bundle 10. The seal ring 600 is an annular member about the axis O. The seal ring 600 according to the present embodiment has a ring main body 610, a ring insertion portion 620, an outside ring seal portion 630, and a ring-fixing member 640.

The seal ring 600 is fixed to the seal ring-fixing hole 650. The seal ring-fixing hole 650 is formed in a discharge side head exterior surface 245C. The seal ring-fixing hole 650 is a screw hole that has a female screw therein.

The ring insertion portion 620 can be inserted into the ring insertion groove 660. The ring insertion groove 660 is formed in the corner portion that is formed by the outer peripheral surface of the discharge side head main body 146C and the discharge side head exterior surface 245C (surface facing the outside in the axial direction Da). The ring insertion groove 660 is recessed with a rectangular sectional shape from the outer peripheral surfaces of the discharge side head exterior surface 245C and the discharge side head main body 146C. A space into which the ring insertion portion 620 can be inserted is formed between the ring insertion groove 660 and the inner peripheral surface of the casing 2C. The ring insertion groove 660 is formed outside the fitting projecting portion 182 in the axial direction Da. The ring insertion groove 660 is formed outside the seal ring-fixing hole 650 in the radial direction Dr. A ring insertion groove first surface 661 facing the outside in the radial direction Dr and a ring insertion groove second surface 662 facing the outside in the axial direction Da constitute the ring insertion groove 660. The ring insertion groove first surface 661 is a surface parallel to the outer peripheral surface of the discharge side head main body 146C and is connected to the discharge side head exterior surface 245C. The ring insertion groove second surface 662 is a flat surface parallel to the discharge side head exterior surface 245C and is a surface connecting the outer peripheral surface of the discharge side head main body 146C and the ring insertion groove first surface 661 to each other.

The inside ring seal portion 670 is capable of providing sealing between the inner peripheral surface of the ring insertion portion 620 and the ring insertion groove first surface 661. The inside ring seal portion 670 has an annular shape and surrounds the discharge side head main body 146C over the entire circumference. The inside ring seal portion 670 according to the present embodiment is an O ring accommodated in an inside attachment groove 671 formed in the ring insertion groove first surface 661. Two inside ring seal portions 670 are disposed to be aligned in the axial direction Da with respect to the ring insertion groove first surface 661.

Two inside attachment grooves 671 are formed to be aligned in the axial direction Da. The inside attachment groove 671 is formed at a position as close as possible to the outside in the axial direction Da in the ring insertion groove first surface 661.

The ring main body 610 has a plate-shaped section and is formed in an annular shape about the axis O.

The ring insertion portion 620 protrudes over the entire circumference with a rectangular sectional shape from the ring main body 610. In other words, the ring insertion portion 620 protrudes in an annular shape from the ring main body 610. The ring insertion portion 620 has a shape allowing the ring insertion groove 660 to be inserted. The protruding amount of the ring insertion portion 620 from the ring main body 610 is shorter than the depth of the ring insertion groove 660 in the axial direction Da (distance between the discharge side head exterior surface 245C and the ring insertion groove second surface 662 in the axial direction Da).

In addition, the surface of the ring main body 610 on the side where the ring insertion portion 620 protrudes is notched outside the position where the ring insertion portion 620 protrudes in the radial direction Dr. As a result, the ring main body 610 is formed such that the thickness on the inside in the radial direction Dr with respect to the position where the ring insertion portion 620 protrudes is thicker than the thickness on the outside in the radial direction Dr with respect to the position where the ring insertion portion 620 protrudes. A ring main body through-hole 611 is formed in the ring main body 610.

The ring main body through-hole 611 is formed at a position overlapping the seal ring-fixing hole 650 when seen from the axial direction Da in a state where the ring insertion portion 620 is inserted in the ring insertion groove 660.

The outside ring seal portion 630 is capable of providing sealing between the outer peripheral surface of the ring insertion portion 620 and the inner peripheral surface of the casing 2C. The outside ring seal portion 630 has an annular shape and surrounds the ring insertion portion 620 over the entire circumference. The outside ring seal portion 630 according to the present embodiment is an O ring accommodated in an outside attachment groove 631 formed in the outer peripheral surface of the ring insertion portion 620. Two outside ring seal portions 630 are disposed to be aligned in the axial direction Da with respect to the outer peripheral surface of the ring insertion portion 620.

Two outside attachment grooves 631 are formed to be aligned in the axial direction Da. The outside attachment groove 631 is formed at a position disposed inside the inside attachment groove 671 in the axial direction Da in a state where the ring insertion portion 620 is inserted in the ring insertion groove 660.

The ring-fixing member 640 is a bolt that has a ring-fixing shaft portion 641 which has an outer peripheral surface provided with a male screw and a ring-fixing head portion 642 which is formed in an end portion of the ring-fixing shaft portion 641. The ring-fixing shaft portion 641 has a tip fixed to the seal ring-fixing hole 650 in a state where the ring-fixing shaft portion 641 is inserted in the ring main body through-hole 611. The ring-fixing head portion 642 is disposed outside the ring main body 610 in the axial direction Da.

In addition, an insertion clearance diameter-enlarged portion 680 enlarging the clearance between the outer peripheral surface of the ring insertion portion 620 and the inner peripheral surface of the casing 2C is formed at a position shifted to the outside in the axial direction Da with respect to the outside ring seal portion 630. Specifically, the insertion clearance diameter-enlarged portion 680 is formed in the end portion of the casing 2C that is outside the outside ring seal portion 630 in the axial direction Da. The insertion clearance diameter-enlarged portion 680 is recessed from the inner peripheral surface of the casing 2C such that the clearance between the outer peripheral surface of the ring insertion portion 620 and the inner peripheral surface of the casing 2C increases. Specifically, in a case where the clearance between the outer peripheral surface of the ring insertion portion 620 and the inner peripheral surface of the casing 2C at the position where the outside ring seal portion 630 is disposed is 0.15 mm to 0.35 mm, the insertion clearance diameter-enlarged portion 680 enlarges the clearance between the outer peripheral surface of the ring insertion portion 620 and the inner peripheral surface of the casing 2C to at least 1.0 mm. The insertion clearance diameter-enlarged portion 680 is formed over the entire circumference at both ends of the casing 2C in the axial direction Da.

A compressor-manufacturing method S14 according to the fourth embodiment will be described below. As illustrated in FIG. 17, the compressor-manufacturing method S14 according to the present embodiment includes a preparation step S104, the bundle disposition step S30, the upper half casing disposition step S40, and a head seal portion movement step S60. Differences from the compressor-manufacturing method S1 according to the first embodiment will be described below.

In the preparation step S104 according to the fourth embodiment, a casing preparation step S114, a bundle preparation step S124, and a head seal portion preparation step S50 are carried out simultaneously.

In the preparation step S104 according to the fourth embodiment, the upper half casing 21C and a lower half casing 22C are prepared. The insertion clearance diameter-enlarged portion 680 is then formed at both ends of the upper half casing 21C in the axial direction Da and at both ends of the lower half casing 22C in the axial direction Da. In addition, in the preparation step S104, each of the rotor 11, the bearing portion 12, the upper half diaphragm 131, the lower half diaphragm 132, the suction side head 141C, the discharge side head 142C, the communication clearance seal portion 16, the fastening portion 17, and the seal ring 600 is prepared by, for example, manufacturing. The inside ring seal portion 670 is then attached with the ring insertion groove 660 formed in the suction side head 141C and the discharge side head 142C, unlike in the first embodiment.

The head seal portion movement step S60 is carried out after the upper half casing disposition step S40 is carried out. In the head seal portion movement step S60, the seal ring 600 is attached from the outside with respect to the suction side head 141C and the discharge side head 142C and the ring insertion portion 620 is moved between the outer peripheral surface of the suction side head 141C and the inner peripheral surface of the casing 2C and between the outer peripheral surface of the discharge side head 142C and the inner peripheral surface of the casing 2C. Specifically, the ring insertion portion 620 is inserted from the outside in the axial direction Da with respect to the ring insertion groove 660 and the ring main body 610 is fixed with respect to the suction side head 141C and the discharge side head 142C by the ring-fixing member 640. By the ring insertion portion 620 being inserted into the ring insertion groove 660, the inside ring seal portion 670 accommodated in the inside attachment groove 671 comes into contact with the inner peripheral surface of the ring insertion portion 620. In addition, the outside ring seal portion 630 accommodated in the outside attachment groove 631 comes into contact with the inner peripheral surface of the casing 2C.

According to the compressor 1C and the compressor-manufacturing method S14 as described above, the seal ring 600 is attached after the bundle 10 and the casing 2C are assembled. As a result, sealing can be performed between the casing 2C and the suction and discharge side heads 141C and 142C. Accordingly, the outside ring seal portion 630 is not disposed before the bundle 10 and the casing 2C are assembled, and the inside ring seal portion 670 is disposed in the ring insertion groove 660 recessed from the outer peripheral surfaces of the suction side head 141C and the discharge side head 142C. Accordingly, damage to an O ring caused by the outside ring seal portion 630 and the inside ring seal portion 670 being sandwiched by the divided surface or being rubbed against an edge of the casing 2C can be reduced in a case where the bundle 10 is installed in the lower half casing 22C and in a case where the upper half casing 21C is installed on the bundle 10. As a result, the sealability between the head 14C and the casing 2C can be stably ensured.

In particular, damage to the outside ring seal portion 630 and the inside ring seal portion 670 can be reliably prevented since the seal ring 600 is detachable from the outside. As a result, the sealability between the head 14C and the casing 2C can be more stably ensured.

In addition, the insertion clearance diameter-enlarged portion 680 is formed at both ends of the casing 2C. Accordingly, the clearance between the outer peripheral surface of the ring insertion groove 660 and the inner peripheral surface of the casing 2C increases. As a result, damage caused by the outside ring seal portion 630 being rubbed against the inner peripheral surface of the casing 2C when the ring insertion portion 620 is inserted into the ring insertion groove 660 can be reduced.

In addition, each of the outside ring seal portion 630 and the inside ring seal portion 670 is doubly disposed to be aligned in the axial direction Da. As a result, the sealability between the head 14C and the casing 2C can be improved.

The seal ring 600 is not limited to a structure that is fixed only to the head 14C as in the fourth embodiment. The seal ring 600 may also be a structure that is fixed only to the casing 2C or a structure that is fixed to each of the head 14C and the casing 2C.

In addition, the ring insertion groove 660 is not limited to being formed only in the head 14C. The ring insertion groove 660 may also be formed only in the casing 2C or across the head 14C and the casing 2C. In addition, the ring insertion groove 660 may not be formed insofar as a space into which the ring insertion portion 620 can be inserted is formed between the head 14C and the casing 2C.

In addition, the insertion clearance diameter-enlarged portion 680 is not limited to being disposed only on the outside ring seal portion 630 side. For example, the insertion clearance diameter-enlarged portion 680 may also be formed on the inside ring seal portion 670 side. The insertion clearance diameter-enlarged portion 680 is then formed in, for example, the corner portion of the ring insertion groove first surface 661 and the discharge side head exterior surface 245C.

In addition, the inside ring seal portion 670 is not limited to being attached to the head 14C as in the present embodiment. For example, the inside ring seal portion 670 may also be attached to the inner peripheral surface of the ring insertion portion 620.

In addition, the outside ring seal portion 630 is not limited to being attached to the ring insertion portion 620 as in the present embodiment. For example, the outside ring seal portion 630 may also be attached to the inner peripheral surface of the casing 2C.

Fifth Embodiment

Hereinafter, a fifth embodiment of the compressor according to the present invention will be described with reference to FIGS. 18 to 21. A compressor 1D according to the fifth embodiment differs from the fourth embodiment in that the compressor 1D has a movement-holding portion allowing the head to move relative to the casing. Accordingly, in the following description of the fifth embodiment, the same reference numerals will be used to refer to the same parts as in the first to fourth embodiments and repetitive description will be omitted.

Figure 18:
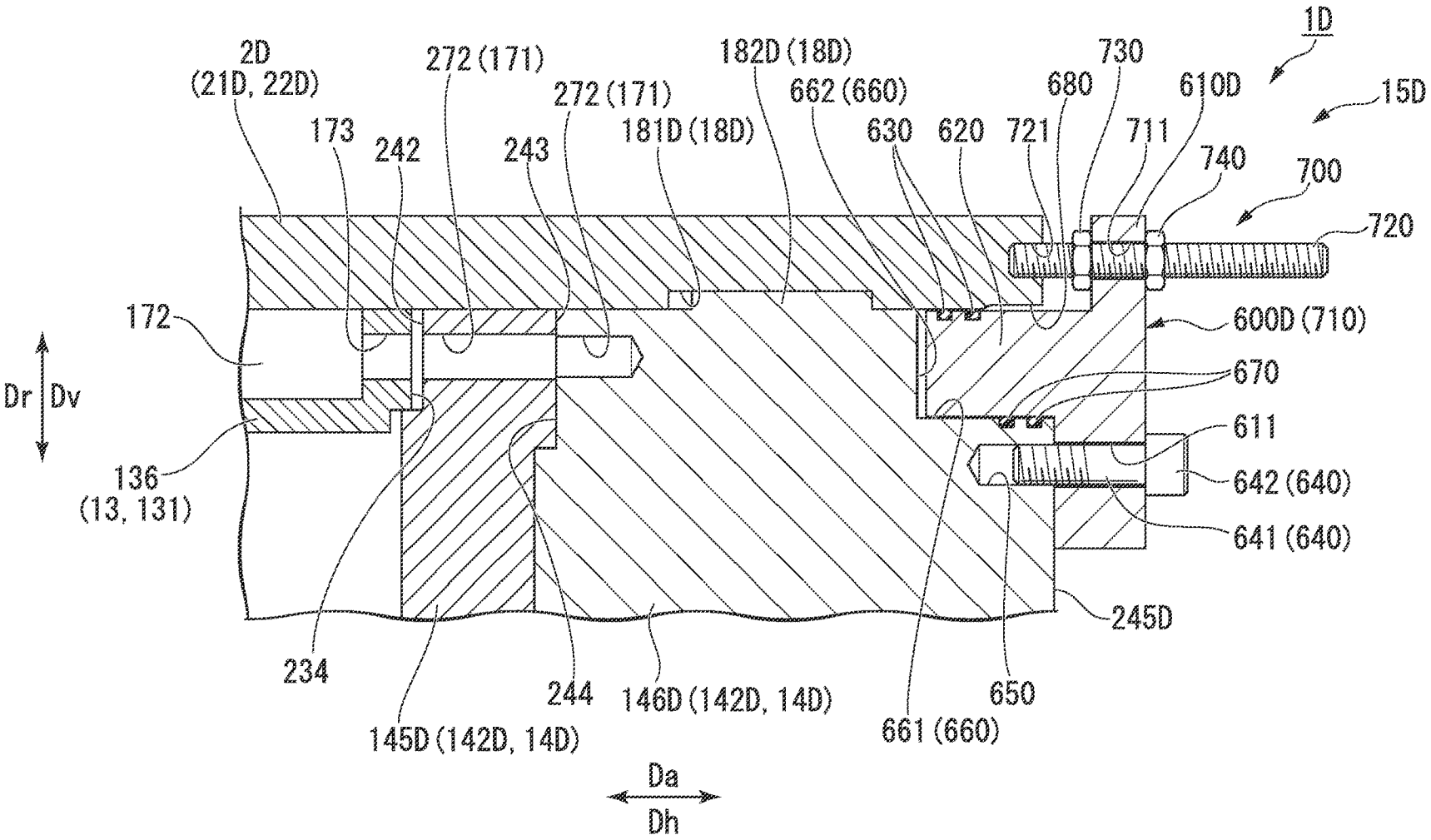
FIG. 18 is an enlarged view of a main part illustrating a head seal portion and a movement-holding portion according to a fifth embodiment of the present invention.

As illustrated in FIG. 18, in the compressor 1D according to the fifth embodiment, the final stage diaphragm 136 is not fixed with respect to a discharge side head 142D. Accordingly, the discharge side head 142D is movable relative to the final stage diaphragm 136 in the axial direction Da in a state where the discharge side head 142D is accommodated in a casing 2D. Specifically, in the axial direction Da, the length of a fitting projecting portion 182D formed on a discharge side head main body 146D is formed to be shorter than the length of a fitting recessed portion 181D formed in the casing 2D.

The compressor 1D is further provided with a movement-holding portion 700. The movement-holding portion 700 is capable of allowing the discharge side head 142D to move relative to the casing 2D in the axial direction Da and holding the position of the discharge side head 142D at any position in the axial direction Da. The movement-holding portion 700 immovably holds the discharge side head 142D at the position that is farthest from the final stage diaphragm 136 and immovable toward the outside in the axial direction Da. The position that is farthest from the final stage diaphragm 136 and immovable toward the outside in the axial direction Da is the position where the surface of the fitting projecting portion 182D on the discharge side head main body 146D that faces the outside in the axial direction Da and the surface of the fitting recessed portion 181D in the casing 2D that faces the inside in the axial direction Da are in contact with each other. The movement-holding portion 700 has a fixed member 710, a shaft member 720, a first nut 730, and a second nut 740.

The fixed member 710 is fixed to the discharge side head main body 146D. The fixed member 710 according to the present embodiment is a ring main body 610D of a seal ring 600D and is integrated with the ring insertion portion 620. A fixed member communication hole 711 communicating in the axial direction Da is formed in the ring main body 610D.

The fixed member communication hole 711 is formed at a position overlapping the casing 2D when seen from the axial direction Da in a state where the ring insertion portion 620 is inserted in the ring insertion groove 660. Specifically, the fixed member communication hole 711 is formed on the side that is opposite to the ring main body through-hole 611 in the radial direction Dr with respect to the position where the ring insertion portion 620 protrudes. In other words, the fixed member communication hole 711 is formed at a thin part of the ring main body 610D.

The shaft member 720 is a screw shaft that has an outer peripheral surface provided with a male screw. One end of the shaft member 720 is fixed to a shaft member-fixing hole 721 formed in the casing 2D in a state where the shaft member 720 is inserted in the fixed member communication hole 711. The shaft member-fixing hole 721 is formed in the end surface of the casing 2D that faces the axial direction Da. The shaft member-fixing hole 721 is a screw hole that has a female screw therein. The shaft member-fixing hole 721 is formed at a position overlapping the fixed member communication hole 711 when seen from the axial direction Da. The other end of the shaft member 720 protrudes from the ring main body 610D toward the outside in the axial direction Da.

In the first nut 730, a female screw screwed to the male screw of the shaft member 720 is provided. The first nut 730 is movable relative to the shaft member 720 along the direction in which the shaft member 720 extends in a state where the shaft member 720 is inserted in the first nut 730. The first nut 730 is disposed on the inside in the axial direction Da (casing 2D side) with respect to the ring main body 610D. The first nut 730 is disposed in contact with the surface of the ring main body 610D that faces the casing 2D side.

In the second nut 740, a female screw screwed to the male screw of the shaft member 720 is provided. As is the case with the first nut 730, the second nut 740 is movable relative to the shaft member 720 along the direction in which the shaft member 720 extends in a state where the shaft member 720 is inserted in the second nut 740. The second nut 740 is disposed on the outside in the axial direction Da with respect to the ring main body 610D. The second nut 740 is disposed in contact with the surface of the ring main body 610D that faces the outside in the axial direction Da.

Figure 19:
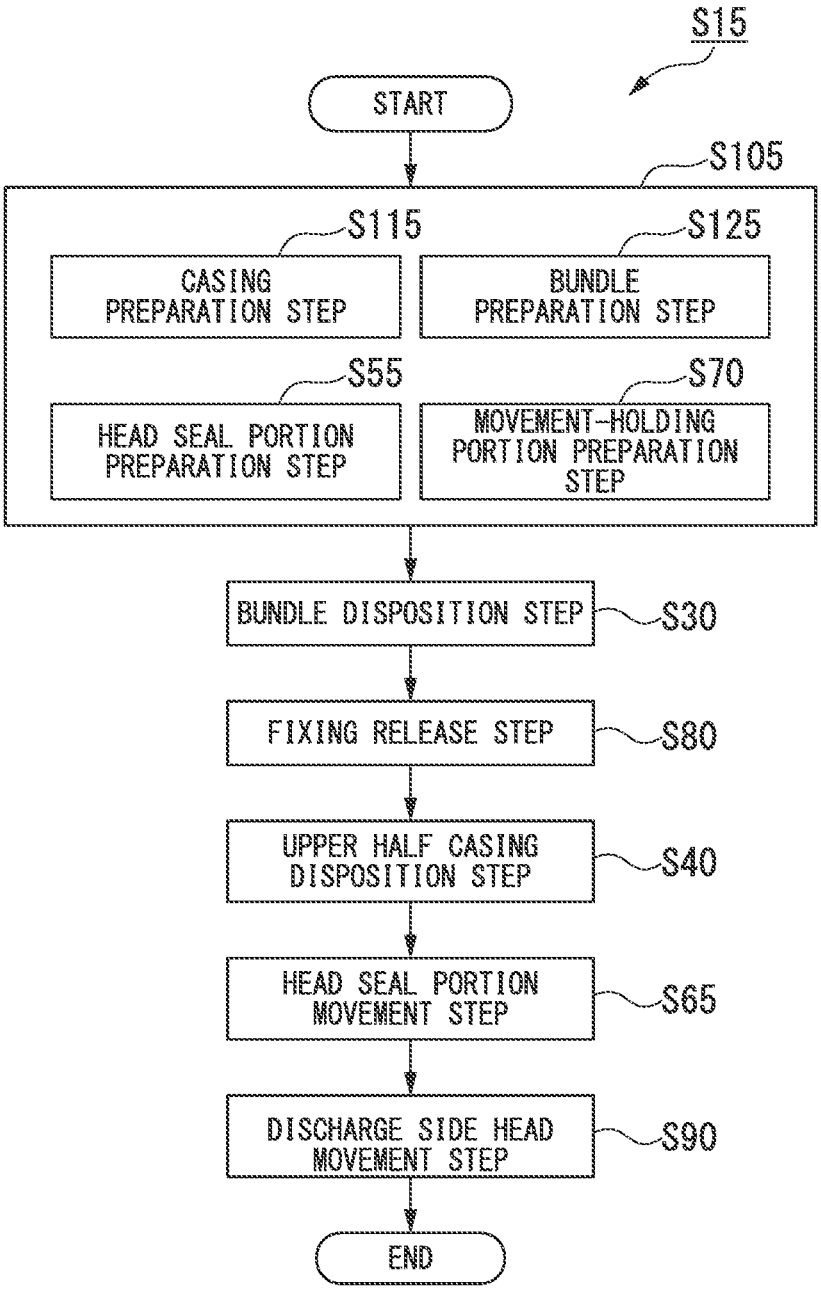
FIG. 19 is a flow diagram showing a compressor-manufacturing method according to the fifth embodiment of the present invention.

A compressor-manufacturing method S15 according to the fifth embodiment will be described below. As illustrated in FIG. 19, the compressor-manufacturing method S15 according to the present embodiment includes a preparation step S105, the bundle disposition step S30, a fixing release step S80, the upper half casing disposition step S40, a head seal portion movement step S65, and a discharge side head movement step S90. Differences from the compressor-manufacturing method S15 according to the fourth embodiment will be described below.

In the preparation step S105 according to the fifth embodiment, a casing preparation step S115, a bundle preparation step S125, a head seal portion preparation step S55, and a movement-holding portion preparation step S70 are carried out simultaneously.

Figure 20:
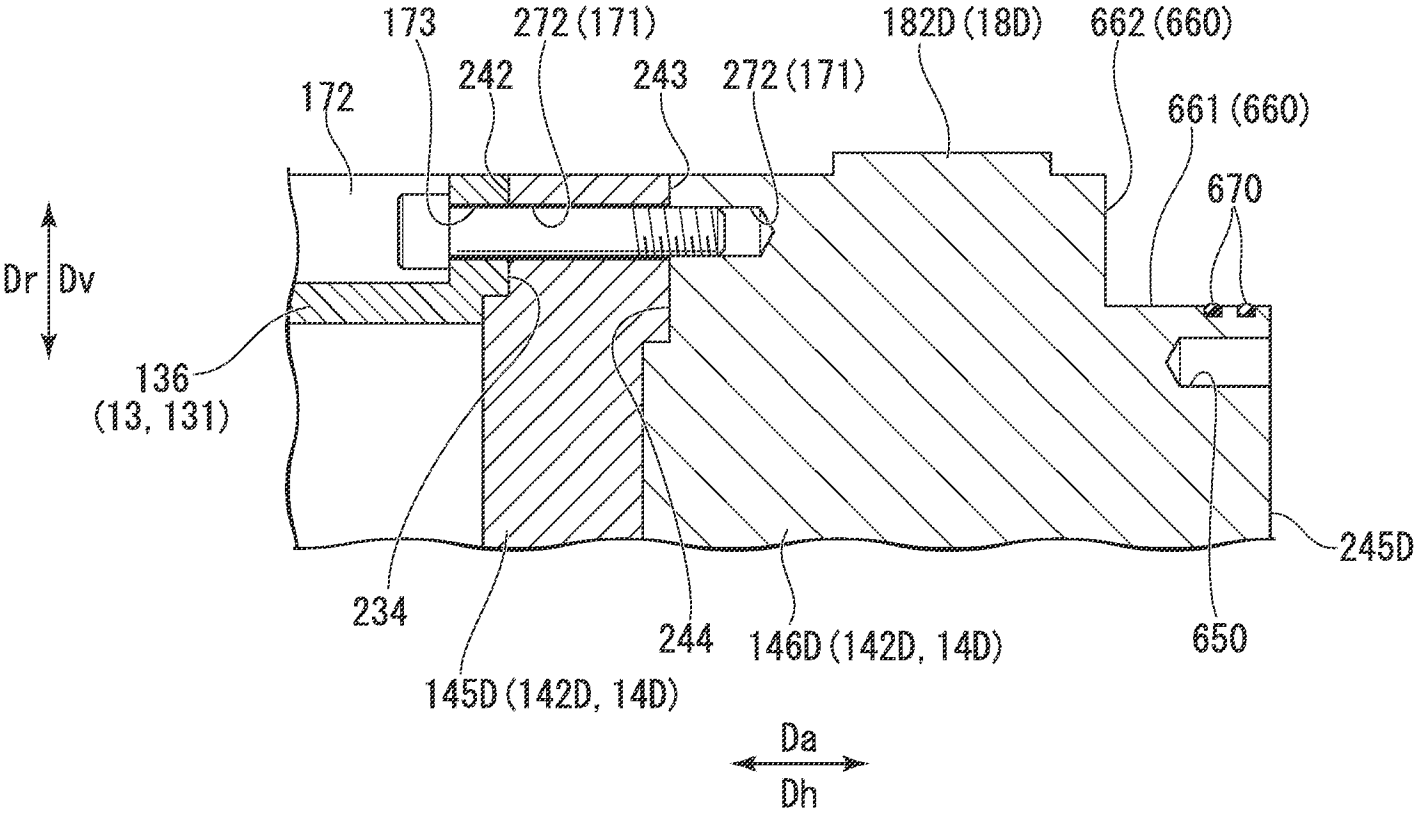
FIG. 20 is an enlarged view of a main part showing a bundle disposition step according to the fifth embodiment of the present invention.

In the preparation step S105 according to the fifth embodiment, an upper half casing 21D and a lower half casing 22D are prepared. The shaft member-fixing hole 721 is then formed in both end surfaces of the upper half casing 21D in the axial direction Da and in both end surfaces of the lower half casing 22D in the axial direction Da. In addition, the fitting recessed portion 181D is formed such that the length in the axial direction Da is approximately several millimeters longer than the fitting projecting portion 182D. In addition, each of the rotor 11, the bearing portion 12, the upper half diaphragm 131, the lower half diaphragm 132, the suction side head 141, the discharge side head 142D, the communication clearance seal portion 16, the fastening portion 17, the seal ring 600D, the shaft member 720, the first nut 730, and the second nut 740 is prepared by, for example, manufacturing. The fixed member communication hole 711 is then formed in the seal ring 600D, unlike in the fourth embodiment. In addition, the discharge side head 142D and the entrance wall 135 fix only the upper half diaphragm 131 without fixing the lower half diaphragm 132. Specifically, as illustrated in FIG. 20, the bolt member 174 is inserted into the fastening through-hole 173 and the fixed through-hole 272 and fixed to the fixed screw hole 271 in a state where the upper half diaphragm 131 of the entrance wall 135 and an exit wall portion 145D fixed to the discharge side head main body 146D are in close contact with each other. As a result, a state occurs where the final stage diaphragm contact surface 234 and the exit inside surface 242 are in contact with each other. As a result, the bundle 10 as a single integrated part is prepared.

Figure 21:
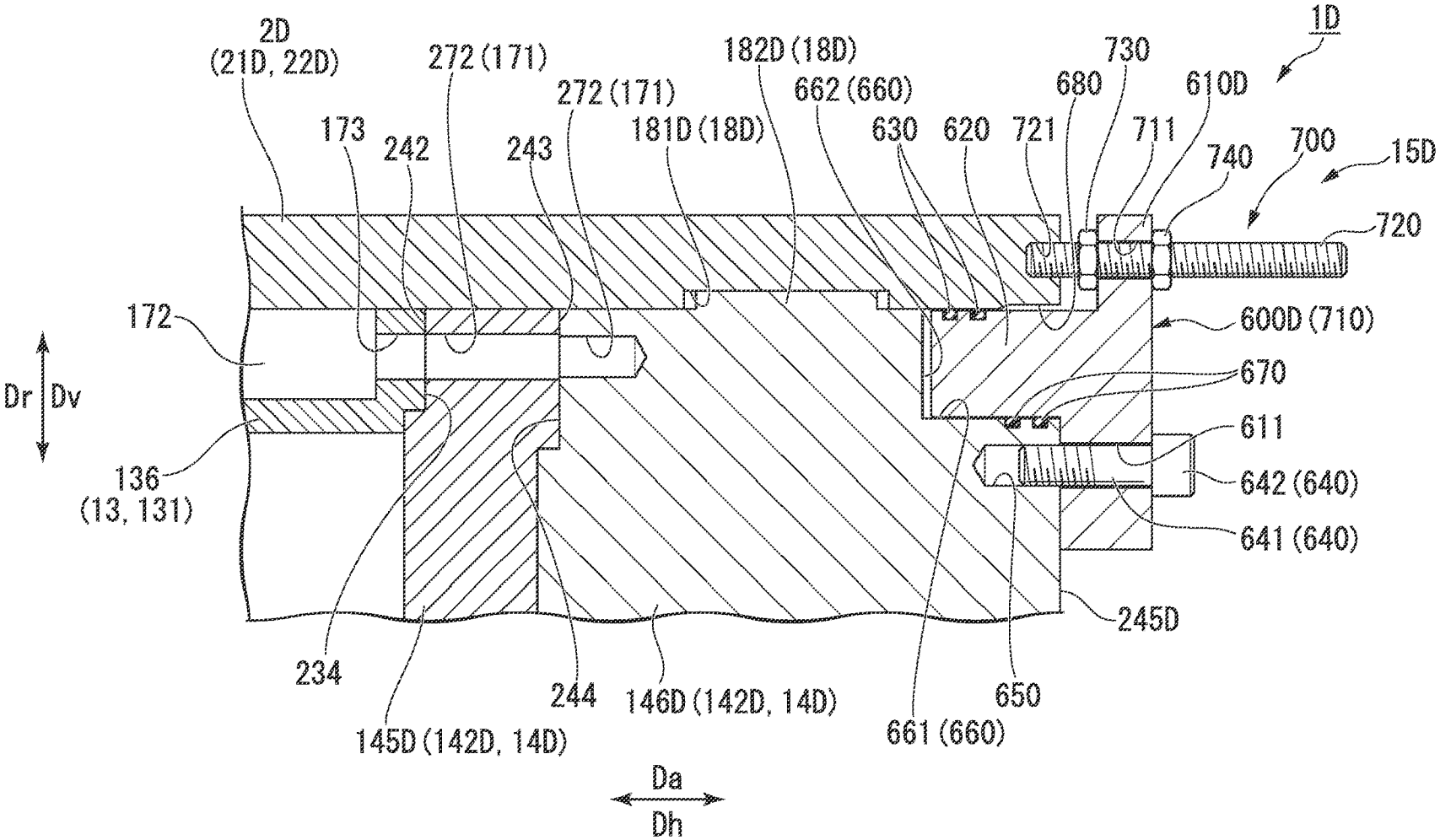
FIG. 21 is an enlarged view of a main part showing a pre-movement discharge side head according to the fifth embodiment of the present invention.

In the fixing release step S80 following the bundle disposition step S30, the bolt member 174 fixed to the fixed screw hole 271 is removed and taken out from the bolt attachment groove 172 as illustrated in FIG. 21. As a result, fixing of the exit wall portion 145D, the discharge side head main body 146D, and the final stage diaphragm 136 is released and the discharge side head 142D becomes relatively movable in the axial direction Da.

The upper half casing disposition step S40 is carried out after the discharge side head 142D becomes movable relative to the final stage diaphragm 136 in the axial direction Da. In the upper half casing disposition step S40, the upper half casing 21D is disposed from above in the vertical direction Dv with respect to the bundle 10. The length of the fitting recessed portion 181D in the axial direction Da is longer than the fitting projecting portion 182D, and thus the discharge side head 142D remains relatively movable in the axial direction Da regardless of the disposition of the upper half casing 21D on the bundle 10.

Subsequently, the discharge side head movement step S90 is carried out after the head seal portion movement step S65 is carried out as illustrated in FIG. 19. As illustrated in FIG. 21, in the discharge side head movement step S90, the shaft member 720 is inserted into the fixed member communication hole 711 in the ring main body 610D. In this state, the shaft member 720 is screwed to the first nut 730 between the ring main body 610D and the casing 2D. The tip of the shaft member 720 to which the first nut 730 is attached is fixed to the shaft member-fixing hole 721. The second nut 740 is screwed to the tip of the shaft member 720 that is on the outside in the axial direction Da. Subsequently, the first nut 730 is moved to the position in contact with the surface of the ring main body 610D that faces the casing 2D side. In addition, the second nut 740 is moved to the position in contact with the surface of the ring main body 610D that faces the outside in the axial direction Da.

With the shaft member 720, the first nut 730, and the second nut 740 attached, the first nut 730 and the second nut 740 are rotated with respect to the shaft member 720 for a movement toward the outside in the axial direction Da. As a result, the ring main body 610D moves toward the outside in the axial direction Da. The seal ring 600D is fixed to the discharge side head main body 146D by the ring-fixing member 640 being fixed to the seal ring-fixing hole 650. Accordingly, by the ring main body 610D moving toward the outside in the axial direction Da, the discharge side head main body 146D and the exit wall portion 145D fixed to the discharge side head main body 146D move to the outside in the axial direction Da. By the discharge side head main body 146D being moved to the position where the surface of the fitting projecting portion 182D facing the outside in the axial direction Da is in contact with the surface of the fitting recessed portion 181D facing the inside in the axial direction Da, the discharge side head main body 146D and the exit wall portion 145D become incapable of moving further toward the outside in the axial direction Da. With the discharge side head main body 146D and the exit wall portion 145D immovable, the first nut 730 and the second nut 740 are moved to positions in close contact with the ring main body 610D. As a result, the position of the ring main body 610D is held and the position of the discharge side head 142D is fixed.

According to the compressor 1D and the compressor-manufacturing method S15 as described above, the discharge side head 142D can be moved from the outside via the seal ring 600D after the bundle 10 and the casing 2D are assembled. Accordingly, the position of the discharge side head 142D in the axial direction Da with respect to the casing 2D can be determined from the outside of the compressor 1D. As a result, the positions of the bundle 10, the lower half casing 22D, and the upper half casing 21D in the axial direction Da do not have to be finely adjusted in a case where the bundle 10 is installed in the lower half casing 22D and in a case where the upper half casing 21D is installed on the bundle 10. In addition, the discharge side head 142D can be moved simply by the first nut 730 and the second nut 740 being rotated with respect to the shaft member 720 for a movement toward the outside in the axial direction Da. Accordingly, the discharge side head 142D can be moved with a simple structure and without a complex device. As a result, assemblability can be improved even more.

In particular, the discharge side head 142D is held at a position close to the outermost side in the axial direction Da by the movement-holding portion 700. As a process gas is compressed in the compressor 1D, the pressure in the discharge opening 237 increases and a force is generated toward the outside in the axial direction Da in the discharge side head 142D. The movement-holding portion 700, however, holds the discharge side head 142D at the position close to the outermost side in the axial direction Da, and thus a movement of the discharge side head 142D during an operation of the compressor 1D can be prevented. As a result, the compressor 1D can be stably operated.

The movement-holding portion 700 is not limited to being a structure that is integrated with the seal ring 600D as in the present embodiment. In other words, the movement-holding portion 700 may also be disposed independently of the head seal portion.

In addition, the movement-holding portion 700 is not limited to a structure that has the shaft member 720, the first nut 730, and the second nut 740 as in the present embodiment insofar as the movement-holding portion 700 is capable of moving the discharge side head 142D in the axial direction Da. Accordingly, the movement-holding portion 700 may also be, for example, a structure moving the discharge side head 142D in the axial direction Da with a hydraulic or compressed air-based jack.

Sixth Embodiment

Figure 23:
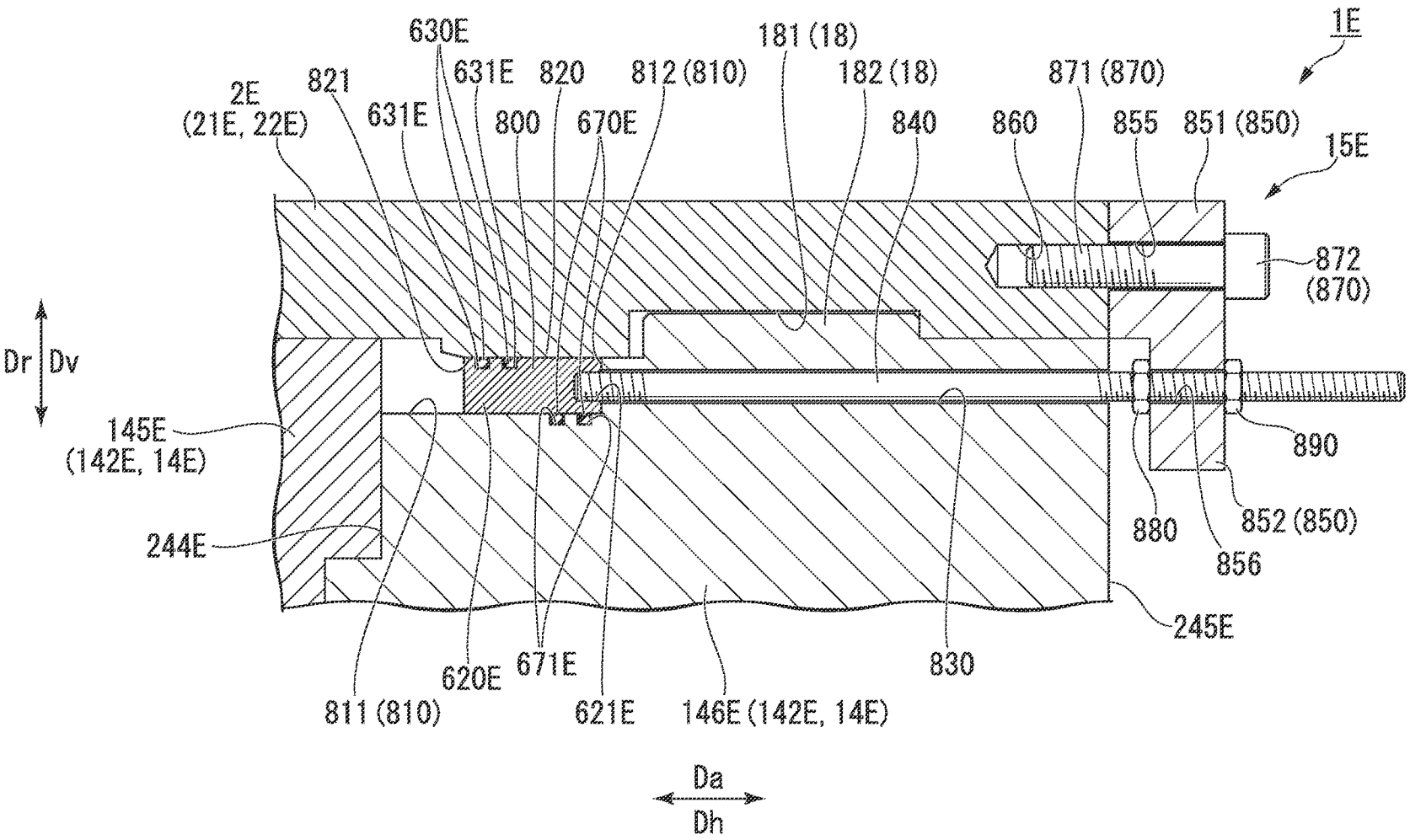
FIG. 23 is an enlarged view of a main part illustrating the appearance of the head seal portion after the movement of the ring insertion portion according to the sixth embodiment of the present invention.
Figure 24:
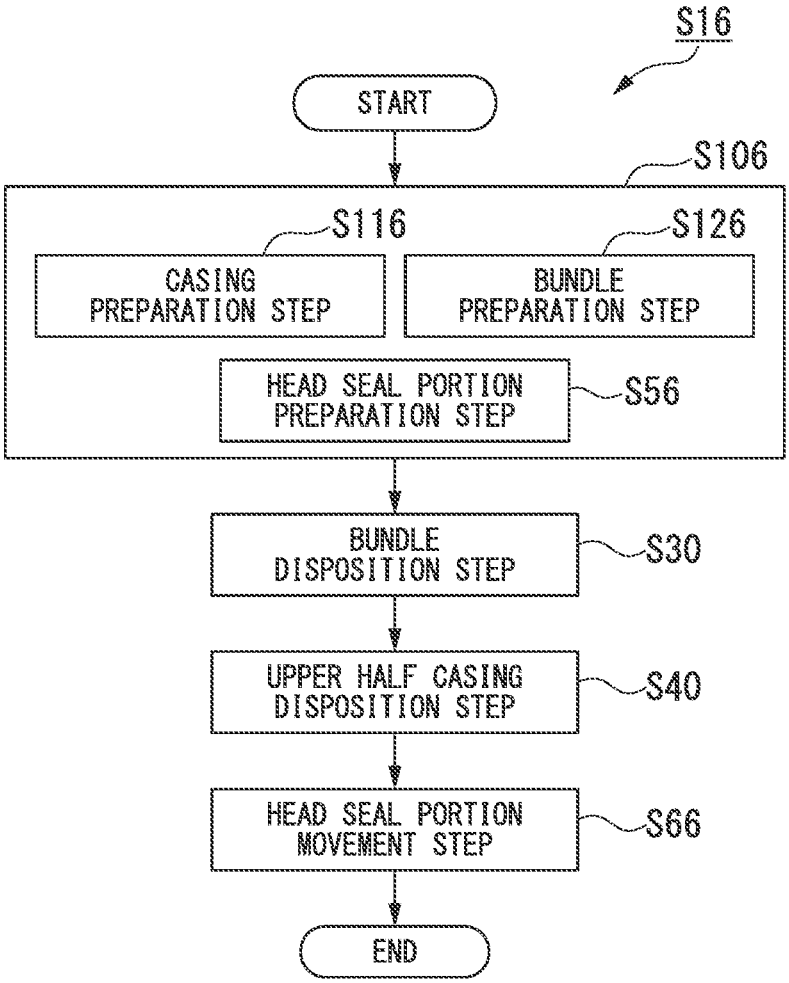
FIG. 24 is a flow diagram showing a compressor-manufacturing method according to the sixth embodiment of the present invention.

Hereinafter, a sixth embodiment of the compressor according to the present invention will be described with reference to FIGS. 22 to 24. A compressor 1E according to the sixth embodiment differs from the fourth embodiment in terms of the configuration of the head seal portion. Accordingly, in the following description of the sixth embodiment, the same reference numerals will be used to refer to the same parts as in the first to fifth embodiments and repetitive description will be omitted.

Figure 22:
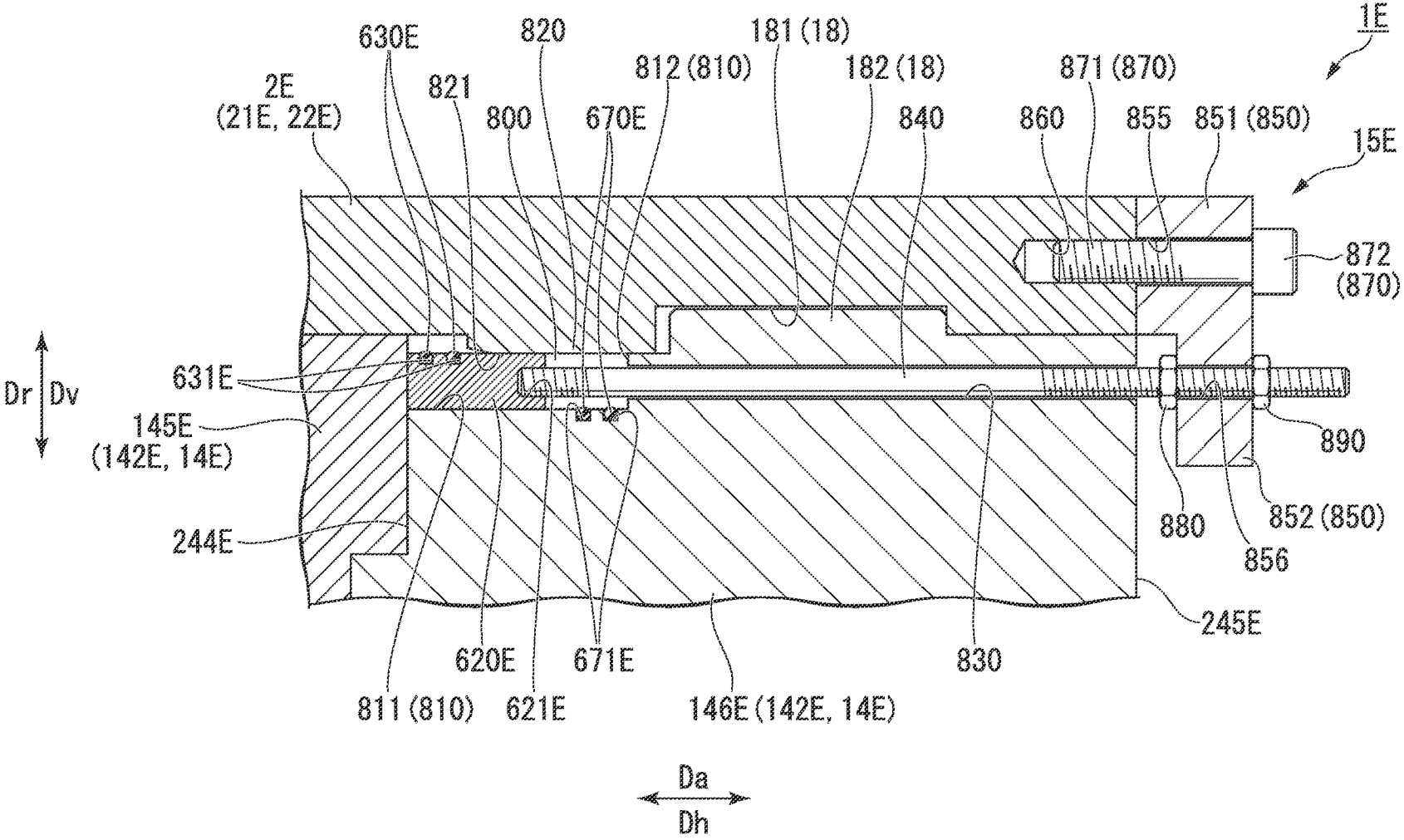
FIG. 22 is an enlarged view of a main part illustrating the appearance of a head seal portion prior to a movement of a ring insertion portion according to a sixth embodiment of the present invention.

As illustrated in FIG. 22, in the compressor 1E according to the sixth embodiment, a ring insertion portion 620E is movable in the axial direction Da from the outside in a state where the ring insertion portion 620E is disposed between a head 14E and a casing 2E in advance. A head seal portion 15E according to the sixth embodiment has a ring accommodating portion 800, the ring insertion portion 620E, an outside ring seal portion 630E, an inside ring seal portion 670E, a ring shaft member insertion hole 830, a ring shaft member 840, a ring shaft member-holding portion 850, a holding portion fixing hole 860, a holding portion-fixing member 870, a ring first nut 880, and a ring second nut 890.

FIG. 22 is an enlarged view of a main part showing the head seal portion 15E disposed between a discharge side head 142E and an upper half casing 21E. Although the head seal portion 15E according to the sixth embodiment is disposed to correspond to each of a suction side head 141E and the discharge side head 142E, the head seal portion 15E around the discharge side head 142E will be described below as an example with reference to FIG. 22.

The ring accommodating portion 800 forms a space where the ring insertion portion 620E can be disposed between a discharge side head main body 146E and the casing 2E. The ring accommodating portion 800 movably accommodates the ring insertion portion 620E between a first position (position of the ring insertion portion 620E in FIG. 22) and a second position (position of the ring insertion portion 620E in FIG. 23). The first position is a position where the inner peripheral surface of the ring insertion portion 620E and the inside ring seal portion 670E are not in contact with each other and the inner peripheral surface of the casing 2E and the outside ring seal portion 630E are not in contact with each other. The second position is a position where the inner peripheral surface of the ring insertion portion 620E and the outer peripheral surface of the head 14E are in contact with the inside ring seal portion 670E and the outer peripheral surface of the ring insertion portion 620E and the inner peripheral surface of the casing 2E are in contact with the outside ring seal portion 630E. The second position is a position shifted to the outside in the axial direction Da with respect to the first position.

The ring accommodating portion 800 has a ring accommodating groove 810 formed in the discharge side head main body 146E and a ring support portion 820 formed in the inner peripheral surface of the casing 2E.

The ring accommodating groove 810 is formed in the corner portion that is formed by a discharge side head main body inside surface 244E (surface of the discharge side head main body 146E facing the inside in the axial direction Da) and the outer peripheral surface of the discharge side head main body 146E. The ring accommodating groove 810 is recessed with a rectangular sectional shape from the outer peripheral surfaces of the discharge side head main body inside surface 244E and the discharge side head 142E. A ring accommodating groove first surface 811 facing the outside in the radial direction Dr and a ring accommodating groove second surface 812 facing the inside in the axial direction Da constitute the ring accommodating groove 810. The ring accommodating groove first surface 811 is a surface parallel to the outer peripheral surface of the discharge side head main body 146E and is connected to the discharge side head main body inside surface 244E. The ring accommodating groove second surface 812 is a flat surface parallel to the discharge side head main body inside surface 244E and is a surface connecting the outer peripheral surface of the discharge side head main body 146E and the ring accommodating groove first surface 811 to each other.

The ring support portion 820 protrudes with a rectangular sectional shape from the inner peripheral surface of the casing 2E. The ring support portion 820 is formed on the inside in the axial direction Da with respect to the fitting recessed portion 181. The ring support portion 820 is formed such that a ring support surface 821 facing the inside in the radial direction Dr is parallel to the ring accommodating groove first surface 811. The ring support portion 820 protrudes such that the distance between the ring support surface 821 and the ring accommodating groove first surface 811 in the radial direction Dr is almost equal to the width of the ring insertion portion 620E in the radial direction Dr when the casing 2E and the bundle 10 are assembled.

A space where the distance between the ring accommodating groove 810 and the inner peripheral surface of the casing 2E in the radial direction Dr is greater than the distance between the ring support surface 821 and the ring accommodating groove first surface 811 in the radial direction Dr when the casing 2E and the bundle 10 are assembled is formed on the inside of the ring support portion 820 in the axial direction Da in the inner peripheral surface of the casing 2E. Specifically, the ring support portion 820 is formed at a position apart in the axial direction Da from the position in the axial direction Da where the discharge side head main body inside surface 244E is formed when the casing 2E and the bundle 10 are assembled.

The ring insertion portion 620E is an annular member that has a rectangular sectional shape. The ring insertion portion 620E has a shape allowing insertion between the ring accommodating groove 810 and the ring support portion 820. The length of the ring insertion portion 620E in the axial direction Da is shorter than the depth of the ring accommodating groove 810 in the axial direction Da (distance between the discharge side head main body inside surface 244E and the ring accommodating groove second surface 812 in the axial direction Da). A ring shaft member-fixing hole 621E is formed in the end surface of the ring insertion portion 620E that faces the outside in the axial direction Da. The ring shaft member-fixing hole 621E is a screw hole that has a female screw therein.

The outside ring seal portion 630E is capable of providing sealing between the outer peripheral surface of the ring insertion portion 620E and the ring support surface 821. The outside ring seal portion 630E has an annular shape and surrounds the ring insertion portion 620E over the entire circumference. The outside ring seal portion 630E according to the present embodiment is an O ring accommodated in an outside attachment groove 631E formed in the outer peripheral surface of the ring insertion portion 620E. Two outside ring seal portions 630E are disposed to be aligned in the axial direction Da with respect to the outer peripheral surface of the ring insertion portion 620E.

Two outside attachment grooves 631E are formed to be aligned in the axial direction Da. The outside attachment groove 631E is formed inside the central position of the ring insertion portion 620E in the axial direction Da.

The inside ring seal portion 670E is capable of providing sealing between the inner peripheral surface of the ring insertion portion 620E and the ring accommodating groove first surface 811. The inside ring seal portion 670E has an annular shape and surrounds the discharge side head main body 146E over the entire circumference. The inside ring seal portion 670E according to the present embodiment is an O ring accommodated in an inside attachment groove 671E formed in the ring accommodating groove first surface 811. Two inside ring seal portions 670E are disposed to be aligned in the axial direction Da with respect to the ring accommodating groove first surface 811.

Two inside attachment grooves 671E are formed to be aligned in the axial direction Da. The inside attachment groove 671E is formed at a position as close as possible to the outside in the axial direction Da in the ring accommodating groove first surface 811 (position close to the ring accommodating groove second surface 812).

The ring shaft member insertion hole 830 is formed at a position overlapping the ring insertion portion 620E when seen from the axial direction Da in a state where the ring insertion portion 620E is accommodated in the ring accommodating portion 800. Specifically, the ring shaft member insertion hole 830 is a hole penetrating the ring accommodating groove second surface 812 and a discharge side head exterior surface 245E in the axial direction Da. The ring shaft member insertion hole 830 has a circular sectional shape with a size allowing the ring shaft member 840 (described later) to be inserted.

The ring shaft member 840 is a screw shaft that has an outer peripheral surface provided with a male screw. One end of the ring shaft member 840 is fixed to the ring shaft member-fixing hole 621E in a state where the ring shaft member 840 is inserted in the ring shaft member insertion hole 830. As a result, the ring shaft member 840 movable in one piece with the ring insertion portion 620E.

The ring shaft member-holding portion 850 is fixed to the casing 2E. The ring shaft member-holding portion 850 has a first holding portion 851 in contact with the casing 2E and a second holding portion 852 disposed apart from the discharge side head main body 146E.

The first holding portion 851 has a plate-shaped section and is formed in an annular shape about the axis O. When the ring shaft member-holding portion 850 is fixed to the casing 2E, the surface of the first holding portion 851 that faces the inside in the axial direction Da is capable of being in contact with the end surface of the casing 2E that faces the outside in the axial direction Da. A first holding portion communication hole 855 communicating in the axial direction Da is formed in the first holding portion 851. The first holding portion communication hole 855 is formed at a position overlapping the end surface of the casing 2E when seen from the axial direction Da in a state where the ring shaft member-holding portion 850 is fixed to the casing 2E.

The second holding portion 852 protrudes from the first holding portion 851 toward the inside in the radial direction Dr. The second holding portion 852 has a plate-shaped section, is thinner in thickness in the axial direction Da than the first holding portion 851, and is formed in an annular shape about the axis O. The surface of the second holding portion 852 that faces the outside in the axial direction Da is a flat surface continuous with the surface of the first holding portion 851 that faces the outside in the axial direction Da. When the ring shaft member-holding portion 850 is fixed to the casing 2E, the surface of the second holding portion 852 that faces the inside in the axial direction Da faces the discharge side head exterior surface 245E at a position apart from the discharge side head exterior surface 245E. A second holding portion communication hole 856 communicating in the axial direction Da is formed in the second holding portion 852. The second holding portion communication hole 856 is formed at a position overlapping the ring shaft member insertion hole 830 when seen from the axial direction Da in a state where the ring shaft member-holding portion 850 is fixed to the casing 2E.

The holding portion fixing hole 860 is formed in the end surface of the casing 2E that faces the outside in the axial direction Da. The holding portion fixing hole 860 is a screw hole that has a female screw therein. The holding portion fixing hole 860 is formed at a position overlapping the first holding portion communication hole 855 when seen from the axial direction Da in a state where the ring shaft member-holding portion 850 is fixed to the casing 2E.

The holding portion-fixing member 870 is a bolt that has a holding portion-fixing shaft portion 871 which has an outer peripheral surface provided with a male screw and a holding portion-fixing head portion 872 which is formed in an end portion of the holding portion-fixing shaft portion 871. The holding portion-fixing shaft portion 871 has a tip fixed to the holding portion fixing hole 860 in a state where the holding portion-fixing shaft portion 871 is inserted in the first holding portion communication hole 855. The holding portion-fixing head portion 872 is disposed outside the first holding portion 851 in the axial direction Da.

In the ring first nut 880, a female screw screwed to the male screw of the ring shaft member 840 is provided. The ring first nut 880 is movable relative to the ring shaft member 840 along the direction in which the ring shaft member 840 extends in a state where the ring shaft member 840 is inserted in the ring first nut 880. The ring first nut 880 is disposed on the inside in the axial direction Da (casing 2E side) with respect to the second holding portion 852. The ring first nut 880 is disposed in contact with the surface of the second holding portion 852 that faces the casing 2E side.

In the ring second nut 890, a female screw screwed to the male screw of the ring shaft member 840 is provided. As is the case with the ring first nut 880, the ring second nut 890 is movable relative to the ring shaft member 840 along the direction in which the ring shaft member 840 extends. The ring second nut 890 is disposed on the outside in the axial direction Da with respect to the second holding portion 852. The ring second nut 890 is disposed in contact with the surface of the second holding portion 852 that faces the outside in the axial direction Da.

A compressor-manufacturing method S16 according to the sixth embodiment will be described below. As illustrated in FIG. 24 and as is the case with the fourth embodiment, the compressor-manufacturing method S16 according to the present embodiment includes a preparation step S106, the bundle disposition step S30, the upper half casing disposition step S40, and a head seal portion movement step S66. Differences from the compressor-manufacturing method S14 according to the fourth embodiment will be described below.

In the preparation step S106 according to the sixth embodiment, the upper half casing 21E and a lower half casing 22E are prepared. The ring support portion 820 is then formed in the inner peripheral surface of the upper half casing 21E and in the inner peripheral surface of the lower half casing 22E. In addition, the holding portion fixing hole 860 is formed in the end surfaces of the upper half casing 21E and the lower half casing 22E that face the outside in the axial direction Da. In addition, in the preparation step S106, each of the rotor 11, the bearing portion 12, the upper half diaphragm 131, the lower half diaphragm 132, the suction side head 141E, the discharge side head 142E, the communication clearance seal portion 16, the fastening portion 17, the ring insertion portion 620E, the outside ring seal portion 630E, the inside ring seal portion 670E, the ring shaft member 840, the ring shaft member-holding portion 850, the ring first nut 880, and the ring second nut 890 is prepared by, for example, manufacturing. The ring accommodating groove 810, the inside attachment groove 671E, and the ring shaft member insertion hole 830 are then formed in the suction side head 141E and the discharge side head main body 146E. The inside ring seal portion 670E is attached to the formed inside attachment groove 671E. In addition, the outside attachment groove 631E and the ring shaft member-fixing hole 621E are formed in the ring insertion portion 620E. In a state where the ring shaft member 840 is inserted in the ring shaft member insertion hole 830, the ring insertion portion 620E is disposed at the first position in the ring accommodating groove 810 with the ring shaft member 840 fixed to the ring shaft member-fixing hole 621E. At the first position, the ring insertion portion 620E and the inside ring seal portion 670E are not in contact with each other. In this state, the bundle 10 as a single integrated part is prepared. The bundle 10 is prepared in a state where the ring shaft member 840 protrudes from both ends in the axial direction Da.

The head seal portion movement step S66 is carried out after the upper half casing disposition step S40 is carried out. In the head seal portion movement step S66, the ring shaft member-holding portion 850 is fixed with respect to the casing 2E by the holding portion-fixing member 870 in a state where the ring shaft member 840 is inserted in the second holding portion communication hole 856. In this state, the ring shaft member 840 is screwed to the ring first nut 880 between the second holding portion 852 and the casing 2E. In addition, the ring second nut 890 is screwed to the tip of the ring shaft member 840 that is on the outside in the axial direction Da. Subsequently, the ring first nut 880 is moved to the position in contact with the surface of the second holding portion 852 that faces the casing 2E side. In addition, the ring second nut 890 is moved to the position in contact with the surface of the second holding portion 852 that faces the outside in the axial direction Da.

Subsequently in the head seal portion movement step S66, the ring first nut 880 and the ring second nut 890 are rotated with respect to the ring shaft member 840 for a movement toward the outside in the axial direction Da. As a result, the ring shaft member 840 moves toward the outside in the axial direction Da. By the movement of the ring shaft member 840, the ring insertion portion 620E also is moved to the outside in the axial direction Da. As a result, the ring insertion portion 620E moves from the first position to the second position. By the ring main body 610 moving to the second position toward the outside in the axial direction Da, the inside ring seal portion 670E accommodated in the inside attachment groove 671E comes into contact with the inner peripheral surface of the ring insertion portion 620E. In addition, the outside ring seal portion 630E accommodated in the outside attachment groove 631E comes into contact with the inner peripheral surface of the casing 2E. In this state, the ring first nut 880 and the ring second nut 890 are moved to positions in close contact with the second holding portion 852. As a result, the position of the ring shaft member 840 is held and the position of the ring insertion portion 620E is fixed at the second position.

According to the compressor 1E and the compressor-manufacturing method S16 as described above, the ring insertion portion 620E disposed in the space that is closed by the casing 2E and the bundle 10 can be moved by the ring shaft member 840 being moved from the outside after the bundle 10 and the casing 2E are assembled. As a result, the ring insertion portion 620E moves from the first position to the second position and sealing can be performed between the casing 2E and the suction and discharge side heads 141E and 142E. Accordingly, as in the fourth embodiment, damage to an O ring caused by sandwiching by the divided surface or rubbing against the casing 2E can be reduced in a case where the bundle 10 is installed in the lower half casing 22E and in a case where the upper half casing 21E is installed on the bundle 10. As a result, the sealability between the head 14E and the casing 2E can be stably ensured.

Although embodiments of the present invention have been described in detail above with reference to accompanying drawings, each of the configurations, configurational combinations, and so on according to the embodiments is an example and configurational addition, omission, substitution, and any other change are possible within the scope not deviating from the purpose of the present invention. In addition, the present invention is not limited by the embodiments and is limited only by claims.

Figure 25:
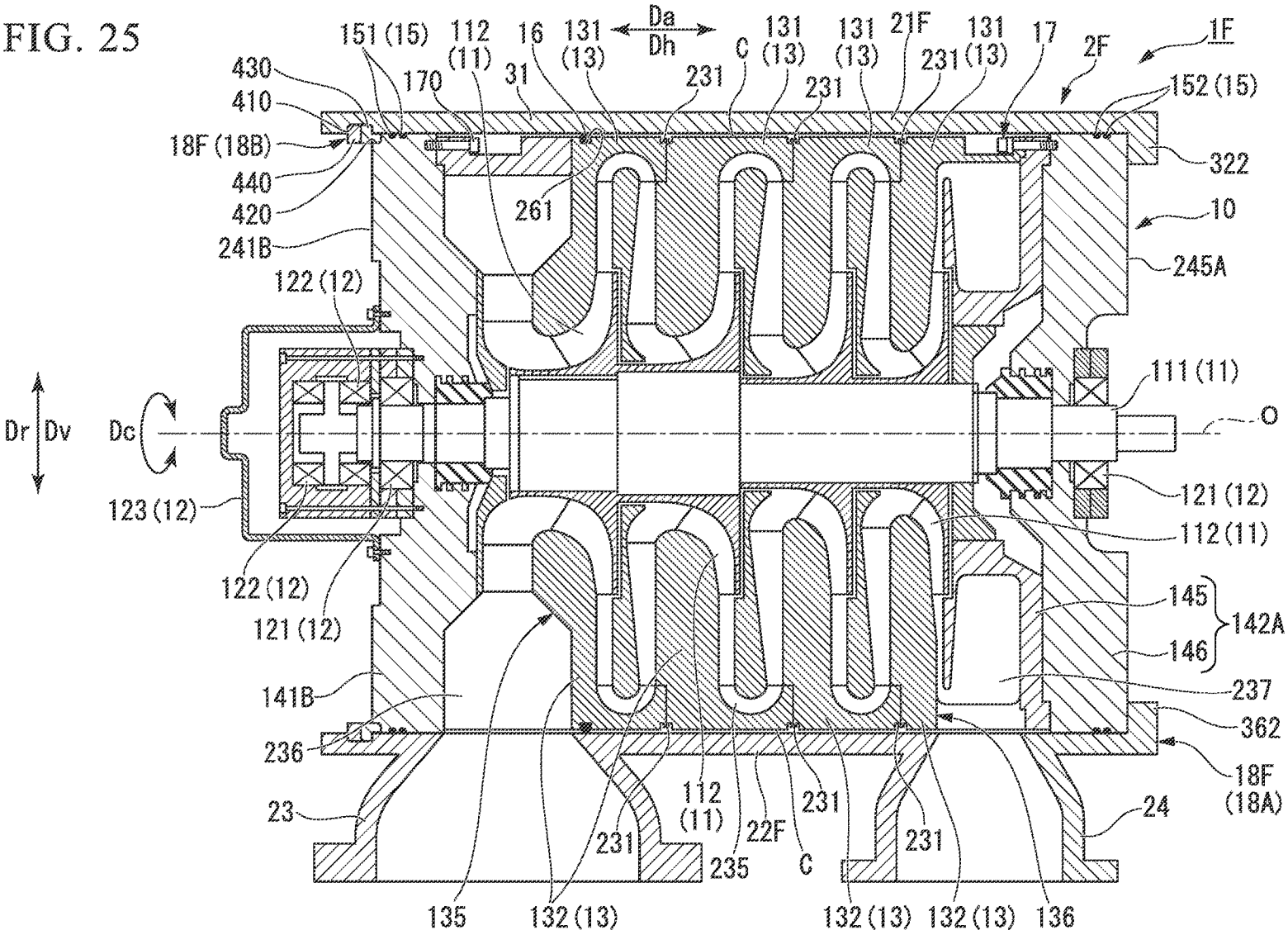
FIG. 25 is a sectional view schematically illustrating the configuration of a compressor according to a first modification example of the present invention.

In other words, the compressor according to the present invention may have a configuration in which any of the above-described embodiments are combined with each other. For example, a compressor 1F according to a first modification example of the embodiments may have a structure in which the structure according to the second embodiment and the structure according to the third embodiment are combined with each other. As illustrated in FIG. 25, the compressor 1F according to the first modification example is provided with a regulating portion 18F that has different structures on the one side and the other side in the axial direction Da.

The regulating portion 18F is similar in configuration to the regulating portion 18B according to the third embodiment on the one side in the axial direction Da and similar in structure to the regulating portion 18A according to the second embodiment on the other side in the axial direction Da.

Accordingly, the end portion of a casing 2F according to the first modification example that is on the one side in the axial direction Da is formed to protrude to the outside in the axial direction Da beyond the suction side head 141B. The regulating accommodating recessed portion 410 is formed in the end portion of the casing 2F that is on the one side in the axial direction Da. In addition, the head regulating accommodating groove 420 is formed in the suction side head 141B. On the one side of the compressor 1F in the axial direction Da, the first regulating member 430 and the second regulating member 440 are attached to the regulating accommodating recessed portion 410 and the head regulating accommodating groove 420.

In addition, the second upper half protruding portion 322 disposed on the outside in the axial direction Da with respect to the discharge side head 142A in an upper half casing 21F and the second lower half protruding portion 362 disposed on the outside in the axial direction Da with respect to the discharge side head 142A in a lower half casing 22F are formed in the end portion of the casing 2F according to the first modification example that is on the other side.

Figure 26:
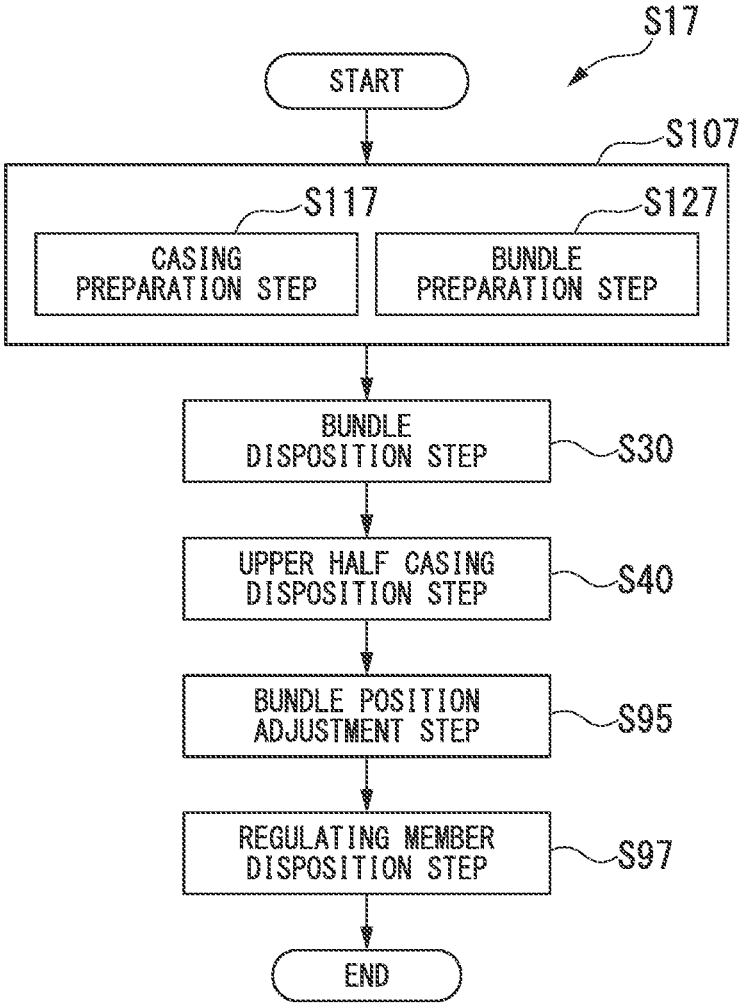
FIG. 26 is a flow diagram showing a compressor-manufacturing method according to the first modification example of the present invention.

A compressor-manufacturing method S17 according to the first modification example will be described below. As illustrated in FIG. 26, the compressor-manufacturing method S17 according to the present embodiment includes a preparation step S107, the bundle disposition step S30, the upper half casing disposition step S40, a bundle position adjustment step S95, and a regulating member disposition step S97.

In the preparation step S107 according to the first modification example, the upper half casing 21F and the lower half casing 22F are prepared (casing preparation step S117). The second upper half protruding portion 322 and the second lower half protruding portion 362 are then formed in the end portions of the upper half casing 21F and the lower half casing 22F that are on the other side in the axial direction Da, respectively. In addition, the regulating accommodating recessed portion 410 is formed in each of the end portions of the upper half casing 21F and the lower half casing 22F that are on the one side in the axial direction Da. In addition, in the preparation step S107, each of the rotor 11, the bearing portion 12, the upper half diaphragm 131, the lower half diaphragm 132, the suction side head 141B, the discharge side head 142A, the communication clearance seal portion 16, and the fastening portion 17 is prepared by, for example, manufacturing (bundle preparation step S127). The head regulating accommodating groove 420 is then formed in the suction side head 141B.

In addition, in the compressor-manufacturing method S17 according to the first modification example, the bundle position adjustment step S95 is carried out after the upper half casing disposition step S40. In the bundle position adjustment step S95, the bundle 10 in the casing 2F is pressed from the one side toward the other side in the axial direction Da such that the discharge side head exterior surface 245A comes into contact with the second upper half protruding portion 322 and the second lower half protruding portion 362. In this state, the position of the bundle 10 in the axial direction Da is adjusted to a position where the first regulating member 430 and the second regulating member 440 can be accommodated with respect to the regulating accommodating recessed portion 410 and the head regulating accommodating groove 420.

The regulating member disposition step S97 is carried out after the bundle position adjustment step S95. With the position of the bundle 10 in the axial direction Da adjusted, the first regulating member 430 is inserted into the regulating accommodating recessed portion 410, and then is inserted into the head regulating accommodating groove 420 by being moved to the inside in the axial direction Da. Subsequently, the second regulating member 440 is press-fitted into the regulating accommodating recessed portion 410 on the outside in the axial direction Da with respect to the first regulating member 430. As a result, a state occurs where the first regulating member 430 and the second regulating member 440 are accommodated in the regulating accommodating recessed portion 410 and the head regulating accommodating groove 420 and in contact with each other. As a result, the compressor 1F according to the first modification example can be similar in action and effect to the second and third embodiments.

Although the manufacturing method according to each of the above-described embodiments is to manufacture a compressor by forming and assembling each part from the beginning, the compressor-manufacturing method S1, S14, S15, S16, S17 is not limited only to the case where the compressor is manufactured from the beginning. For example, the compressor-manufacturing method S1, S14, S15, S16, S17 may also be used when the compressor is disassembled and reassembled during repair and inspection. An already used bundle is then replaced with a new bundle prepared through the bundle preparation step S12, S124, S125, S126. In addition, further included during the repair and inspection are a step of removing the upper half casing beforehand and a step of removing the already used bundle.

In addition, in the compressor-manufacturing method S1, S14, S15, S16, S17, the casing preparation step, the bundle preparation step, the head seal portion preparation step, and the movement-holding portion preparation step of the preparation step are not limited to being carried out simultaneously as described above. For example, the casing preparation step, the bundle preparation step, the head seal portion preparation step, and the movement-holding portion preparation step may also be carried out at different timings.

Figure 27:
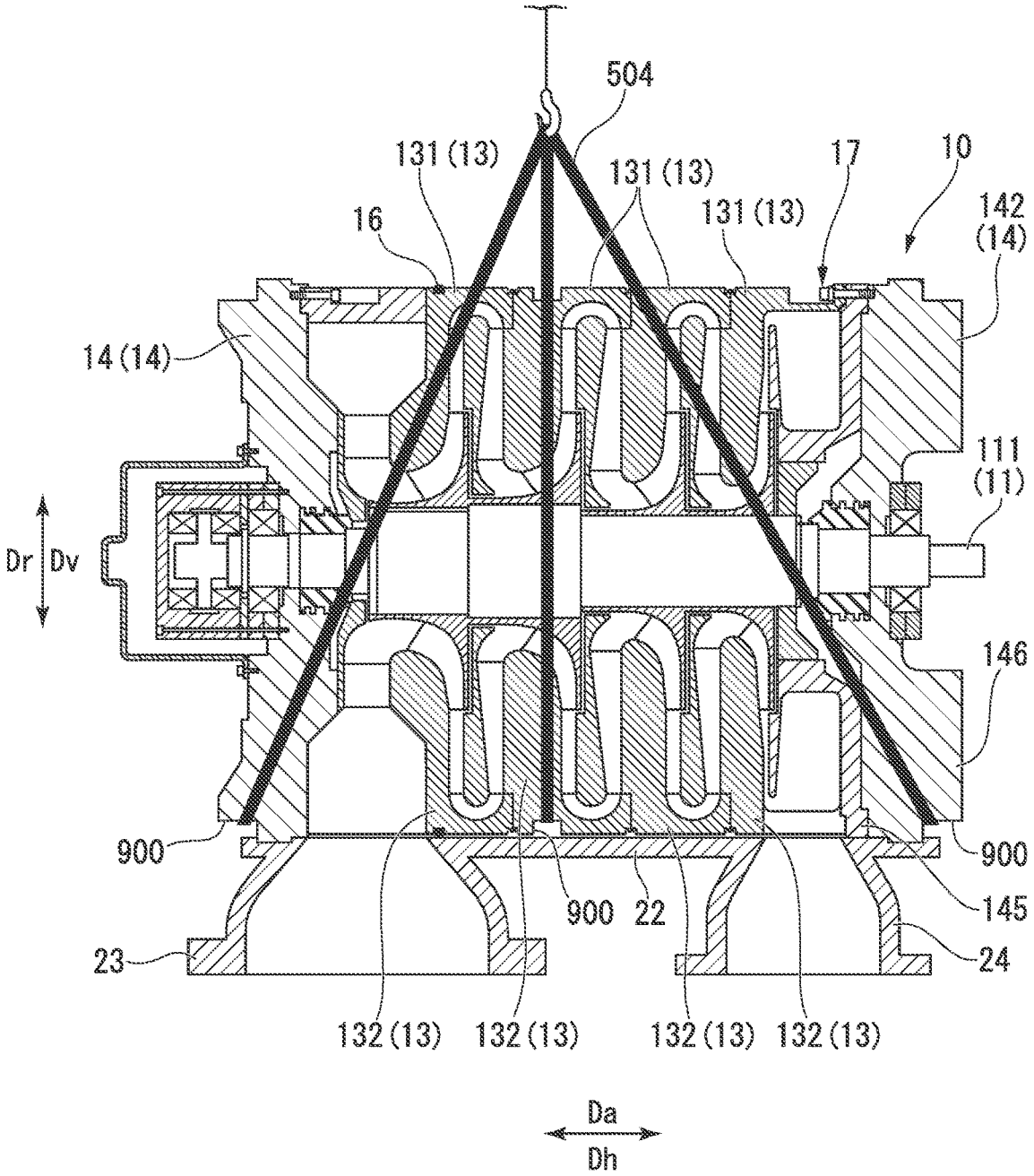
FIG. 27 is a sectional view illustrating a wire attachment position at a time when a bundle according to a second modification example of the present invention is moved.

In addition, although the eye bolt 501 is used when the bundle 10 is lifted or lowered in each of the above-described embodiments, the present invention is not limited to the method. For example, as a second modification example, a wire insertion portion 900 allowing the wire 504 to be inserted may also be formed at the lower ends of the suction side head 141 and the discharge side head main body 146 in the vertical direction Dv as illustrated in FIG. 27. The wire insertion portion 900 may be formed as a groove recessed from the outer peripheral surfaces of the suction side head 141 and the discharge side head main body 146 or as a hole penetrating the suction side head 141 and the discharge side head main body 146. In addition, the wire insertion portion 900 may be formed in any of the diaphragms 13 as well as the suction side head 141 and the discharge side head main body.

By the wire insertion portion 900 being disposed as described above, the bundle 10 can be moved in a stable state even in the event of an increase in the weight of the bundle 10.

Although a uniaxial multistage centrifugal compressor has been exemplified as the compressor in each of the above-described embodiments, the compressor according to the present invention is not limited thereto. For example, the compressor may also be an axial flow compressor.

In addition, the configuration of the bundle is not limited to the configuration according to the present embodiment. The bundle may also include a non-casing component of the compressor and a part of the configuration according to the present embodiment may also be excluded.

With the compressor described above, leakage between the inner peripheral surface of a casing and the outer peripheral surface of a diaphragm can be reduced.

EXPLANATION OF REFERENCES

1, 1A, 1B, 1C, 1D, 1E, 1F Compressor
Da Axial direction
Dr Radial direction
Dv Vertical direction
Dh Horizontal direction
Dc Circumferential direction
2, 2A, 2B, 2C, 2D, 2E, 2F Casing
21, 21A, 21B, 21F Upper half casing
211 Upper half casing-divided surface
22, 22A, 22F Lower half casing
221 Lower half casing-divided surface
23 Suction port
24 Discharge port
10 Bundle
11 Rotor
O Axis
111 Rotor shaft
112 Impeller
12 Bearing portion
121 Journal bearing
122 Thrust bearing
123 Bearing cover
13 Diaphragm
131 Upper half diaphragm
132 Lower half diaphragm
231 Welding portion
232 Welding portion groove
135 Entrance wall
233 Seal attachment groove
136 Final stage diaphragm
234 Final stage diaphragm contact surface
235 Casing flow path
236 Suction opening
237 Discharge opening
14, 14A, 14B, 14C, 14D, 14E Head
141, 141A, 141B, 141C Suction side head
241, 241A, 241B, 241C Suction side head exterior surface
142, 142A, 142B, 142C, 142D, 142E Discharge side head
145, 145D Exit wall portion
242 Exit inside surface
243 Exit outside surface
146, 146A, 146B, 146C, 146D, 146E Discharge side head main body
244, 244E Discharge side head main body inside surface
245, 245A, 245B, 245C, 245D, 245E Discharge side head exterior surface
15, 15C, 15D, 15E Head seal portion
151 First head seal portion
152 Second head seal portion
251 Head seal attachment groove
16 Communication clearance seal portion
261 Clearance seal attachment groove
C Communication clearance
170 Bolt member
17 Fastening portion
171 Fixed hole
271 Fixed screw hole
272 Fixed through-hole
172 Bolt attachment groove
273 Groove inside surface
173 Fastening through-hole
174 Bolt member
274 Shaft portion
275 Head portion
175 Elastic member
18, 18A, 18B, 18D, 18F Regulating portion
181, 181D Fitting recessed portion
182, 182D Fitting projecting portion
S1, S14, S15, S16, S17 Compressor-manufacturing method
S10, S104, S105, S106, S107 Preparation step
S11, S114, S115, S116, S117 Casing preparation step

S12, S124, S125, S126, S127 Bundle preparation step
S30 Bundle disposition step
501 Eye bolt
502 Guide rod
503 Guide plate
504 Wire
S40 Upper half casing disposition step
31 Upper half casing main body
32 Upper half protruding portion
321 First upper half protruding portion
322 Second upper half protruding portion
35 Lower half casing main body
36 Lower half protruding portion
361 First lower half protruding portion
362 Second lower half protruding portion
370 Clearance enlarged recessed portion
410 Regulating accommodating recessed portion
411 Regulating accommodating recessed portion bottom surface
412 Regulating accommodating recessed portion first surface
413 Regulating accommodating recessed portion second surface
420 Head regulating accommodating groove
421 Regulating accommodating groove first surface
422 Regulating accommodating groove second surface
430 First regulating member
431 First accommodating portion
432 Second accommodating portion
440 Second regulating member
600, 600D Seal ring
610, 610D Ring main body
611 Ring main body through-hole
620, 620E Ring insertion portion
630, 630E Outside ring seal portion
631, 631E Outside attachment groove
640 Ring-fixing member
641 Ring-fixing shaft portion
642 Ring-fixing head portion
650 Seal ring-fixing hole
660 Ring insertion groove
661 Ring insertion groove first surface
662 Ring insertion groove second surface
670, 670E Inside ring seal portion
671, 671E Inside attachment groove
680 Insertion clearance diameter-enlarged portion
S50, S55, S56 Head seal portion preparation step
S60, S65, S66 Head seal portion movement step
700 Movement-holding portion
710 Fixed member
711 Fixed member communication hole
720 Shaft member
721 Shaft member-fixing hole
730 First nut
740 Second nut
S70 Movement-holding portion preparation step
S80 Fixing release step
S90 Discharge side head movement step
800 Ring accommodating portion
810 Ring accommodating groove
811 Ring accommodating groove first surface
812 Ring accommodating groove second surface
820 Ring support portion
821 Ring support surface
621E Ring shaft member-fixing hole
830 Ring shaft member insertion hole
840 Ring shaft member
850 Ring shaft member-holding portion
851 First holding portion
855 First holding portion communication hole
852 Second holding portion
856 Second holding portion communication hole
860 Holding portion fixing hole
870 Holding portion-fixing member
871 Holding portion-fixing shaft portion
872 Holding portion-fixing head portion
880 Ring first nut
890 Ring second nut
900 Wire insertion portion
S95 Bundle position adjustment step
S97 Regulating member disposition step

What is claimed is:

1. A compressor comprising:

a casing including an upper half casing having an upper half casing-divided surface as a horizontal surface facing downward in a vertical direction and a lower half casing having a lower half casing-divided surface capable of abutting against the upper half casing-divided surface, the casing having a tubular shape with a first end and a second end that are open;

a bundle including an impeller rotatable about an axis, a plurality of diaphragms in which the impeller is accommodated and a flow path introducing a fluid to a flow path of the impeller is formed, and annular heads respectively fixed on the first end and the second end of the casing in an axial direction in which the axis extends with respect to the plurality of diaphragms and closing the first end and the second end of the casing, the bundle being accommodated in the casing;

a communication clearance seal portion sealing a communication clearance extending in the axial direction between an outer peripheral surface of one of the diaphragms and an inner peripheral surface of the casing such that a suction port through which the fluid flows in and a discharge port through which the fluid is discharged communicate with each other; and a regulating portion provided in at least one of the casing and one of the annular heads and regulating a position of the one of the annular heads in the axial direction with respect to the casing, wherein the communication clearance seal portion is an O ring;

a clearance seal attachment groove to which the communication clearance seal portion is attached is formed in the outer peripheral surface of the one of the diaphragms; and the clearance seal attachment groove is tapered to become deeper toward a circumferential direction from at least one of an upper vertex of the one of the diaphragms in the vertical direction and a lower vertex of the one of the diaphragms in the vertical direction.

2. The compressor according to claim 1, wherein the clearance seal attachment groove is formed to be deepest at both end positions in a horizontal direction having an angular difference of 90 degrees in the circumferential direction of the one of the diaphragms with respect to the upper vertex of the one of the diaphragms in the vertical direction and the lower vertex of the one of the diaphragms in the vertical direction.

3. The compressor according to claim 1, wherein the regulating portion includes:

a fitting recessed portion formed in one of an outer peripheral surface of the one of the annular heads and the inner peripheral surface of the casing; and a fitting projecting portion formed in the other one of the outer peripheral surface of the one of the annular heads and the inner peripheral surface of the casing and fitting into the fitting recessed portion.

4. The compressor according to claim 1, wherein the regulating portion is disposed on an outside in the axial direction as a side opposite to a side where the one of the diaphragms is disposed with respect to the one of the annular heads in the casing and is in contact with a surface of the one of the annular heads facing the outside in the axial direction.

5. The compressor according to claim 4, wherein the casing includes:

a casing main body covering an outer peripheral surface of the bundle; and a protruding portion protruding from the casing main body toward an inside in a radial direction and in contact with an end surface of the one of the annular heads facing the outside in the axial direction, as the regulating portion.

6. The compressor according to claim 4, wherein the regulating portion includes:

a regulating accommodating recessed portion recessed from the inner peripheral surface of the casing to be positioned on the outside in the axial direction at least in part with respect to the one of the annular heads;

a first regulating member accommodated in the regulating accommodating recessed portion and in contact with the surface of the one of the annular heads facing the outside in the axial direction; and a second regulating member accommodated in the regulating accommodating recessed portion outside the first regulating member in the axial direction and in contact with a surface of the regulating accommodating recessed portion facing an inside in the axial direction as a side where the one of the diaphragms is disposed and a surface of the first regulating member facing the outside in the axial direction.

7. The compressor according to claim 1, further comprising:

a fastening portion fixing the one of the diaphragms and a discharge side head as the one of the annular heads disposed at a position adjacent to the discharge port, wherein the fastening portion includes:

a fixed hole formed in a surface of one of the discharge side head and the one of the diaphragms facing the axial direction and having a female screw in the fixed hole;

a fastening through-hole formed at a position overlapping the fixed hole when seen from the axial direction in the other one of the discharge side head and the one of the diaphragms;

a bolt member having a shaft portion having an outer peripheral surface provided with a male screw and fixed to the fixed hole in a state where the shaft portion is inserted in the fastening through-hole and a head portion formed in an end portion of the shaft portion; and one selected from a group consisting of: a belleville spring washer, a rubber material, and a spring member disposed between the head portion of the bolt member and a surface where the fastening through-hole is formed.

8. The compressor according to claim 1, further comprising:

a head seal portion providing sealing between the one of the annular heads and the casing, wherein the head seal portion includes:

an annular ring insertion portion movable in the axial direction from an outside of the one of the annular heads or the casing and inserted between the outer peripheral surface of the one of the annular heads and the inner peripheral surface of the casing;

an inside ring seal portion providing sealing between an inner peripheral surface of the ring insertion portion and the outer peripheral surface of the one of the annular heads; and an outside ring seal portion providing sealing between an outer peripheral surface of the ring insertion portion and the inner peripheral surface of the casing.

9. The compressor according to claim 8, wherein the ring insertion portion is detachable with respect to the one of the annular heads or the casing from the outside in the axial direction as a side opposite to a side where the one of the diaphragms is disposed.

10. The compressor according to claim 8, wherein an insertion clearance diameter-enlarged portion enlarging a clearance between the outer peripheral surface of the ring insertion portion and the inner peripheral surface of the casing is formed at a position shifted in the axial direction with respect to the outside ring seal portion.

11. The compressor according to claim 1, wherein a wire insertion portion allowing a wire to be inserted is formed at a lower end of the one of the annular heads in the vertical direction.

12. A compressor comprising:

a casing including an upper half casing having an upper half casing-divided surface as a horizontal surface facing downward in a vertical direction and a lower half casing having a lower half casing-divided surface capable of abutting against the upper half casing-divided surface, the casing having a tubular shape with a first end and a second end that are open;

a bundle including an impeller rotatable about an axis, a plurality of diaphragms in which the impeller is accommodated and a flow path introducing a fluid to a flow path of the impeller is formed, and annular heads respectively fixed on the first end and the second end of the casing in an axial direction in which the axis extends with respect to the plurality of diaphragms and closing the first end and the second end of the casing, the bundle being accommodated in the casing;

a communication clearance seal portion sealing a communication clearance extending in the axial direction between an outer peripheral surface of one of the diaphragms and an inner peripheral surface of the casing such that a suction port through which the fluid flows in and a discharge port through which the fluid is discharged communicate with each other;

a regulating portion provided in at least one of the casing and one of the annular heads and regulating a position of the one of the annular heads in the axial direction with respect to the casing; and a movement-holding portion that allows a discharge side head as the one of the annular heads disposed at the position adjacent to the discharge port to move relative to the casing in the axial direction and capable of holding the position of the discharge side head at any position in the axial direction, wherein the movement-holding portion holds the position of the discharge side head at a position where the discharge side head is farthest from the one of the diaphragms and where the discharge side head is immovable toward an outside in the axial direction as a side opposite to a side where the one of the diaphragms is disposed.

13. The compressor according to claim 12, wherein the movement-holding portion includes:

a fixed member having a fixed member communication hole communicating in the axial direction and fixed to the discharge side head;

a shaft member having an outer peripheral surface provided with a male screw and one end fixed to the casing in a state where the shaft member is inserted in the fixed member communication hole;

a first nut in which a female screw is formed, the first nut being movable relative to the shaft member in a state where the shaft member is inserted in the first nut and disposed on a casing side in the axial direction with respect to the fixed member; and a second nut in which a female screw is formed, the second nut being movable relative to the shaft member in a state where the shaft member is inserted in the second nut and disposed on a side opposite to the first nut with respect to the fixed member.

14. A compressor-manufacturing method comprising:

preparing a casing including an upper half casing having an upper half casing-divided surface as a horizontal surface facing downward in a vertical direction and a lower half casing having a lower half casing-divided surface capable of abutting against the upper half casing-divided surface, the casing having a tubular shape with a first end and a second end that are open;

preparing a bundle including an impeller rotatable about an axis, a plurality of diaphragms in which the impeller is accommodated and a flow path introducing a fluid to a flow path of the impeller is formed, annular heads respectively fixed on the first end and the second end of the casing in an axial direction in which the axis extends with respect to the plurality of diaphragms and closing the first end and the second end of the casing, and a communication clearance seal portion disposed in an outer peripheral surface of the one of the diaphragms;

accommodating the bundle on an inner peripheral side of the lower half casing by lowering the bundle from above in the vertical direction with respect to the lower half casing such that a clearance extending in the axial direction such that a suction port through which a fluid flows in and a discharge port through which a fluid is discharged communicate with each other is formed between the outer peripheral surface of the one of the diaphragms and an inner peripheral surface of the lower half casing;

disposing the upper half casing on the lower half casing in which the bundle is accommodated, by lowering the upper half casing from above in the vertical direction with respect to the bundle such that the clearance extending in the axial direction such that the suction port and the discharge port communicate with each other is formed between the outer peripheral surface of the one of the diaphragms and an inner peripheral surface of the upper half casing and abutting the upper half casing-divided surface against the lower half casing-divided surface;

preparing a movement-holding portion that allows a discharge side head as the one of the annular heads disposed at a position adjacent to the discharge port to move relative to the casing in the axial direction and capable of holding the position of the discharge side head at any position in the axial direction;

releasing the discharge side head from the one of the diaphragms, the releasing the discharge side head is carried out after the accommodating of the bundle on an inner peripheral side of the lower half casing and before the disposing of the upper half casing on the lower half casing; and holding the position of the discharge side head after a movement by the movement-holding portion to a position where the discharge side head is farthest from the one of the diaphragms and the discharge side head is immovable toward an outside in the axial direction as a side opposite to a side where the one of the diaphragms is disposed, the holding the position of the discharge side head is carried out after the disposing of the upper half casing on the lower half casing, wherein the bundle is disposed such that the communication clearance seal portion comes into contact with the inner peripheral surface of the lower half casing in a state where a position of the one of the annular heads in the axial direction is regulated with respect to the lower half casing during the accommodating of the on an inner peripheral side of the lower half casing, and the upper half casing is disposed such that the communication clearance seal portion comes into contact with the inner peripheral surface of the upper half casing in a state where the position of the one of the annular heads in the axial direction is regulated with respect to the upper half casing during the disposing of the upper half casing on the lower half casing.

15. The compressor-manufacturing method according to claim 14, wherein the discharge side head and the one of the diaphragms are fixed only at a position communicating with the outside in a state where the bundle is disposed with respect to the lower half casing during the preparing of the bundle.

16. The compressor-manufacturing method according to claim 14, further comprising:

preparing a head seal portion including an annular ring insertion portion insertable between an outer peripheral surface of the one of the annular heads and an inner peripheral surface of the casing, an inside ring seal portion capable of providing sealing between an inner peripheral surface of the ring insertion portion and the outer peripheral surface of the one of the annular heads, and an outside ring seal portion capable of providing sealing between an outer peripheral surface of the ring insertion portion and the inner peripheral surface of the casing, the head seal portion providing sealing between the one of the annular heads and the casing; and after the disposing of the upper half casing on the lower half casing, bringing the inside ring seal portion into contact with the inner peripheral surface of the ring insertion portion and the outer peripheral surface of the one of the annular heads and brining the outside ring seal portion into contact with the outer peripheral surface of the ring insertion portion and the inner peripheral surface of the casing by moving the ring insertion portion in the axial direction from an outside of the one of the annular heads or the casing.

17. The compressor-manufacturing method according to claim 16, wherein the ring insertion portion is inserted between the outer peripheral surface of the one of the annular heads and the inner peripheral surface of the casing from an outside in the axial direction as a side opposite to a side where the one of the diaphragms is disposed with respect to the one of the annular heads or the casing in the moving of the ring insertion portion in the axial direction from the outside of the one of the annular heads or the casing.

* * * * *